United States Patent [19]

Wilsdorf et al.

[11] 4,415,635

[45] Nov. 15, 1983

[54] ELECTRIC BRUSH

[75] Inventors: Doris Wilsdorf; Heinz G. F. Wilsdorf; Charles M. Adkins, III, all of Charlottesville, Va.

[73] Assignee: The University of Virginia, Charlottesville, Va.

[21] Appl. No.: 138,716

[22] Filed: Apr. 9, 1980

[51] Int. Cl.[3] ..... H01R 39/00

[52] U.S. Cl. ..... 428/611; 310/248; 310/252; 428/161; 428/652; 428/653; 428/656; 428/661; 428/671; 428/673; 428/674; 428/675; 428/678; 428/670; 428/607

[58] Field of Search ..... 310/251-253, 310/248; 75/DIG. 1; 428/607, 651, 652, 653, 656, 611, 614, 660-665, 669-685

[56] References Cited

U.S. PATENT DOCUMENTS

| | | | |
|---|---|---|---|
| 3,254,189 | 5/1966 | Evanicsko, Jr. et al. | 75/DIG. 1 |
| 3,357,824 | 12/1967 | Saarivinta | 148/32.5 |
| 3,733,573 | 5/1973 | Dieterich | 428/670 |
| 3,821,024 | 6/1974 | Wilkin et al. | 428/929 |
| 3,828,417 | 8/1974 | Divecha | 428/614 |
| 3,840,350 | 10/1974 | Tucker, Jr. | 428/614 |
| 4,226,917 | 10/1980 | Tsuruoka, Jr. | 428/675 |
| 4,277,708 | 7/1981 | McNab et al. | 310/252 |

OTHER PUBLICATIONS

Adkins, C. M. et al., *Electrical Contacts* ILL Techn., Chicago, pp. 1-14, (1979).

Weast, R. C., Ed; *Handbook Chemistry and Physics* CRC Co., pp. B87, 134, 150, (1970).

*Primary Examiner*—Michael L. Lewis

*Attorney, Agent, or Firm*—Oblon, Fisher, Spivak, McClelland & Maier

[57] ABSTRACT

A multifiber electrical brush formed of an electrically conductive matrix material having plural electrically conducting fiber wires embedded therein and extending therefrom, wherein the fiber wires have a diameter varying from 1 to 120μm, a length on the order of 100 times greater than the diameter thereof, and a packing density between 1-25%. Suitable materials for the fiber wires are platinum, gold, silver, copper, palladium, or niobium which may be embedded in a copper, silver, or other suitable matrix material, or copper embedded in an aluminum matrix. The fiber wires may be provided with a coating of a suitable barrier material on the lateral surfaces thereof as may be required to protect the fiber wires from etching during removal of the matrix material, or to prevent and/or retard interdiffusion between the matrix material and the fiber wire material during annealing or hot-forming of brush stock, and/or to impart improved electrical performance to the resultant electrical brush. The electrical brush is fabricated typically by drawing, cutting, bundling and redrawing metal fiber wires, with or without a coating or casing of a barrier material, packed in a tube of matrix material, whereupon after shaping of the multi-filamentary ends to the shape of an object to which the brush is to make contact, the matrix is etched away to a predetermined length, preferably under high centrifugal forces in a centrifuge and/or with the application of ultrasound.

33 Claims, 13 Drawing Figures

GOLD FIBERS IN COPPER MATRIX

100μm

Nb FIBERS IN COPPER MATRIX

COMPARISON OF 0.1 $IN^2$ METAL FIBER AND MONOLITHIC CARBON BRUSHES OPERATING UNDER MINIMUM TOTAL LOSS CONDITIONS. J = 2000 $A/IN^2$; S = 35 M/S

ELECTRIC BRUSH

BACKGROUND OF THE INVENTION

1. Field of the Invention

This invention relates to an electrical brush for making electrical connection to an object having a predetermined shape and a predetermined orientation relative to the brush, such as a slip ring in a motor or electrical generator, or a stationary contact in a switch. This invention also relates to a method of making such an electrical brush.

2. Description of the Prior Art

Electrical brushes for utilization in electrical applications have long been known in the prior art. Perhaps the earliest modern electrical brush was disclosed by Edison in U.S. Pat. No. 276,233, which resulted in numerous suggested improvements on electrical brushes, as well as related inventions which have otherwise never found significant application.

Thomson, in U.S. Pat. No. 539,454, recognized various advantages of electrical brushes constructed of plural lightly metalized carbon filaments, and in particular the improved brush conductivity, elasticity and reduced mechanical and electrical resistance thereby provided.

More modern development of electrical brushes is evidenced in U.S. Pat. No. 3,668,451 to McNab and U.S. Pat. No. 3,821,024 to Wilkin et al. In the McNab patent is disclosed an electrical brush formed of refractory nonconducting fibers, each of which has deposited thereon a metal film on the surface thereof to carry current. According to McNab, the fibers can be of very small diameter, less than 10,000ths of an inch, and with a relatively thin metallic coating resulting in a considerably more flexible brush having greater current carrying capacity than the brushes known prior to that time. In the Wilken et al patent, an electrical brush is constructed using carbon fibers coated with an underlayer of nickel and an outer layer of silver having an average filament diameter of 7.5 μm coated with metal layers estimated as having thicknesses of on the order of 1 μm. According to Wilkin et al, improved electrical performance is thereby attained due to the fact that the nickel underlayer adheres better to the carbon fiber while making excellent connection to the silver outer layer. In addition to nickel, underlayers of chromium, iron and cobalt are identified as being suitable, while overlayers of gold, copper and alloys of silver and copper are also identified as being suitable overlayers.

Insofar as the prior art methods of making fiber brushes are concerned, these methods were rather straightforward as long as metal fibers or wires having diameters of 100 μm or more were used, namely via the mechanical assembling of bundles of fibers like ordinary bruushes. In that case one may begin with already assembled wire or fiber materials such as grounding cables, spooled wire or fibers, or woven material out of which the weft, for example, is removed, leaving only the warp. With carbon fibers such methods are feasible down to much smaller diameters since carbon fibers are commercially available in tows and at relatively modest cost, including diameters of the individual filaments on the order of 10 μm. With metals, the cost of wire material rises very steeply with decreasing diameters and becomes prohibitive.

A grave disadvantage of mechanical methods of brush making using fibers of small diameters is the difficulty of reliably adjusting the packing density on a small scale, as well as to shape the brush surface to conform to the surface of an object to which the brush is ultimately required to make electrical contact. Shaping of the brush surface is further complicated where an angle of attack other than 90° is required to make contact with the object, for example, a rotor in an electrical motor or generator. Shaping of the brush is not necessary for brush diameters that are sufficiently small. Also, it does not pose much of a problem if the packing density is high, for example, 25% or higher depending on fiber smoothness, since at such packing density the internal friction among the fibers renders the brush relatively stiff. However, at low packing density serious problems are otherwise encountered.

Various methods, as represented by U.S. Pat. No. 3,394,213 to Roberts et al and U.S. Pat. No. 3,277,564 to Webber et al, are disclosed in the prior art for forming microscopic filaments of long length. As taught by Webber et al, a sheathed wire is firstly drawn down through a suitable die to reduce the diameter of the wire within the sheath, whereupon a plurality of the reduced sheath wires are then disposed within a sheath formed of a suitable matrix material which may but need not necessarily comprise the same material as the sheath. The bundle of sheathed wires is then drawn down to define another reduced diameter, which can be successively drawn down to even smaller diameters as may be required for a particular application. Individual filaments of reduced diameter are then obtained from the final bundle by etching away the matrix material. In the Roberts et al disclosure, plural filaments having a diameter of under 15 μm are formed by providing in a housing material a bundle of substantially parallel sheathed elongated drawable elements from which the filaments are to be formed, evacuating the housing, heat forming the evacuated housed bundle, cold drawing the bundle to further reduce the cross-section of the elements therein and then removing the housing and sheathing materials by means of etching.

Another prior art patent of interest is U.S. Pat. No. 3,818,588 to Bates, which discloses an electrical brush constructed by molding an aligned array of metal coated carbon fibers onto a block. According to Bates, the block may be several times the required length and width of a brush, in which case it is then cut into strips corresponding to the desired length of the brush. The coating is then removed for part only of the lengths of the brush to expose the individual carbon fibers at one end but leaving them consolidated for connection to a conductor at the other end, whereupon the strips are finally cut up to form individual brushes.

Although the concept of metal fiber electrical brushes is not of itself new, widespread introduction of metal fiber brushes has been prevented, presumably for several reasons. Firstly, fiber brushes tend to be more expensive than solid, i.e. "monolithic" brushes. Secondly, the monolithic graphite brush was successfully improved to the point that from the technical viewpoint, its losses are easily tolerable for the large majority of common applications, its lifetime is long, and its cost low, albeit the cost of energy lost in the brushes will often exceed their cost. Thirdly, while the braod concept of fiber brushes was known, a theoretical understanding of the interrelationship of brush parameters, such as packing density, fiber diameter, brush pressure and fiber length, as well as experimental testing, was lacking, thereby effectively precluding derivation of optimum brush parameter combinations. Additionally, past failure to achieve superior performance hypothesized for metal brushes may have further discouraged purposeful research, to the extent that metal fiber electrical brushes exhibiting the expected performance have not heretofore been available.

During the past several years, a new interest in the development of improved brushes, whether fiber or monolithic, has arisen due to the development of engineering concepts and planned devices which call for very low "noise" of the brushes, or very high current densities, or high relative speeds, often with only small potential differences driving the currents, demanding much lower losses per ampere conducted than was previously permissible, or any combination of the above conditions. As a result, the prior art brushes cannot meet the envisioned considerably more stringent requirements, necessitating the development of the improved metal fiber electrical brush of the invention.

SUMMARY OF THE INVENTION

Accordingly, one object of this invention is to provide a new and improved multifiber electrical brush capable of meeting the stringent requirements of modern applications, i.e. capable of operating at high current densities and high relative speeds with reduced losses per ampere conducted, and low noise.

Another object of this invention is to provide a novel metal fiber electrical brush having a large number of current carrying spots (called a-spots), and good compliance for operation at reduced mechanical loading.

Yet another object of this invention is to provide a novel metal fiber electrical brush exhibiting lower electrical and/or mechanical losses, especially at high velocities.

Another object of this invention is to provide a novel metal fiber electrical brush exhibiting low contact resistance when making electrical connection to stationary as well as moving or rotating contacts.

Another object is to provide a novel metal fiber electrical brush which produces considerably lower electrical/radio noise than heretofore possible.

Yet another object is to provide a novel metal fiber electrical brush which can be utilized with or without lubrication.

Another object of this invention is to provide a novel metal fiber electrical brush which exhibits the above-noted improved performance regardless of whether or not the brush is conducting direct or alternating current.

A further object of this invention is to provide a novel method for producing a new and improved multifiber electrical brush exhibiting reduced friction among the fibers to enable individual flexing of the individual fibers.

Yet another object of this invention is to provide a new and improved method as above-noted, resulting in the production of smooth, well separated generally parallel fibers.

A further object of this invention is to provide a novel method for producing the above-noted multifiber electrical brush, wherein the composite shape of the contacting brush surface is shaped in correspondence to the shape and relative position of an object, such as a rotor, slip ring, or stationary contact, to which the electrical brush is intended to make contact.

Another object of the present invention is to provide a novel method, readily adaptable for larger scale technology, for producing the requisite multifiber electrical brush.

These and other objects are achieved according to the invention by providing a new and improved electrical brush for making electrical connection to an object having a predetermined shape and relative position, wherein the brush is constructed of an electrically conductive matrix material having plural electrically conductive wire fibers embedded therein, each of the fiber wires having a diameter between 1 and 120 μm and extending from the matrix material a length equal to at least 20 times the individual fiber diameter, with a packing density relative to the cross-sectional area of the matrix material varying from 1 to 25%. In preferred embodiments, noble metals, iron, nickel, tungsten, niobium or copper and their high concentration alloys are employed as fiber materials with or without a surface covering, called a "barrier material" in the following, comprising one or more layered components such as of a noble metal, aluminum, nickel or copper, carbon or an organic compound, singly or in various combinations and sequences of layering, in connection with an electrically conductive matrix material with a melting point above 150° C. such as copper, aluminum, silver or their alloys. The above list will illustrate the concepts but is not exhaustive with other materials also being under consideration. In one embodiment, the barrier material is applied by placing each fiber wire into a tubing before being formed into part of the multi-filamentary brush stock by the methods described above, or else the barrier material is applied chemically, electrolytically, by dipping, by spraying, by chemical vapor deposition, by electrophoresis, by sputtering, by plasma deposition or by other means, or by any of these methods singly or in combination, including the use of tubing as noted.

Advantageously, the electrical brush of the invention is characterized by the fact that the ends of the fiber wires extending from the matrix are compositely shaped to correspond to the predetermined shape and relative position of the object with which the multifiber electrical brush is to contact.

According to the invention, the multifiber electrical brush is produced by etching away from a suitably shaped end of a piece of brush stock all but the bare fibers, or the fibers including part of the barrier material, or the fibers with the barrier material intact, and optionally depositing a single or multilayer surface covering to the lateral and/or end surfaces of the fiber ends protruding from the solid part of the brush stock remaining after the etching, by means of subliming, sputtering, electroplating, electrophoresis, chemical vapor deposition, plasma deposition, or other suitable methods singly or in combination.

In one method, brush stock, incorporating the desired matrix, barrier, and fiber materials, of desired outer shape and dimensions, with fibers of predetermined diameter and of a predetermined number, is produced by packing a predetermined number of wires of a fiber material, with or without a barrier material, and wires of a matrix material, not necessarily of the same diameter of cross-sectional shape, in a tube consisting of the matrix material or of some other suitable material, and drawing, extruding and/or rolling the tube with the fiber wires and the matrix wires placed therein through at least one die or increment to reduce the diameter of the fiber wires to a predetermined size. If so desired, the tube next undergoes one or more rebundling and further drawing, rolling and/or extrusion operations, optionally after first removing the outermost tubing, including cutting into predetermined lengths, placing into another tube of predetermined size and shape, of the matrix material or some other suitable material, and drawing, extruding and/or rolling through at least one die or increment to reduce the cross-section of the new outer tube to a predetermined size and shape. Alternatively, the rebundling can be effected, without cutting, in a continuous process through employing two or more tubings as produced in the manner first described.

The numbers and diameters of the fiber and matrix wires at the start of the process of brush stock manufacture, as well as the inner and outer diameters of the tubings used and the number of rebundlings are chosen to yield the desired number and diameter of the fiber wires when the brush stock has been rolled, extended, and/or drawn to its desired final shape and size.

Swaging is another possible method by which the discussed operations of lengthening the outer tubing via reducing its cross-sectional area can be effected. However, to the extent that swaging yields distinctly less uniform deformation than the other methods, thus leading to less straight and less uniform fiber wires than obtainable by drawing, rolling and/or extrusion, swaging is a less desirable method. Of the latter three methods, extrusion results in the most uniform deformation in many cases but requires very expensive machinery not ordinarily available in a laboratory, but nevertheless feasible for commercial purposes.

The mechanical working, i.e. drawing, rolling and/or extruding, can be performed at ambient or elevated temperature as may be most convenient and appropriate for the choice of fiber, matrix and barrier materials. At or before the first onset of cracking, if any, of matrix, barrier or fibers, annealing treatments may be interposed as required. Usually, unless other considerations intervene, care is taken to keep annealing times brief, e.g. in the range of about 2 to 20 minutes for any one segment of brush stock, and at as low a temperature as will adequately soften those parts of the brush stock which otherwise are subject to cracking. This is done in order to forestall undesirable coarsening of the crystallites in the fibers and/or matrix and to limit interdiffusion.

After fiber brush stock has been procured, as described or by any other method, the method includes cutting off a suitable length of the fiber brush stock, this piece being at least equal to that required to accommodate the intended fiber lengths and brush contour, plus at least about one millimeter in the direction of the fibers so that the fibers remain securely anchored after etching and so that the brush may be handled, including the optional addition of holding devices, during the subsequent steps of the manufacturing as well as during later use.

The method further includes mechanically shaping one end surface of the brush stock inverse to the shape and in correspondence to the relative position of the rotor, slip ring or contact to which the finally produced brush is to ultimately contact. The method further includes etching away all the other tubing, the matrix, and none, part or all of the barrier material, if any, to the predetermined length from a specified point on the end surface, say, where the axis of the fiber stock intersects the end surface of the brush stock or piece of brush stock. Optionally, the cutting operation may be done before the shaping operation or after it, or it may be done after the etching operation. Shaping of the brush stock end may be done by grinding, sawing, turning on a lathe, milling, drilling or any other similar methods singly or in combination.

In cases demanding high precision and/or performance, the brush stock end should be shaped not exactly but generally to the shape and relative position of the object to which the brush shall ultimately make contact so as to make allowance for differentials in the (elastic) fiber deformation when the brush is in use, for the reason that the fibers are generally not all of the same length, especially not when the contacted object is curved, and are not all subjected to the same forces. For example, when running on a rotor the fibers on the leading, but not the trailing, edge are supported by other fibers behind them.

The brush stock may alternatively be produced by coating wires of a fiber material, with or without a barrier material, with a layer of a matrix material, not necessarily different from the fiber material, and packing a predetermined number of such wires, alone or together with a predetermined number of wires of the matrix material, in a tube consisting of the matrix material or of some other suitable material, and proceeding with drawing, rolling and/or extruding, annealing, rebundling, shaping and etching as before.

Alternatively, the brush stock may also be produced by placing at least one wire of a fiber material, with or without a barrier material, in a first tube of matrix material and drawing, extruding and/or rolling through at least one die or increment to reduce the wire diameter to a predetermined size, whereupon the drawn, rolled and/or extruded tube is cut into plural pieces of predetermined length, which pieces are rebundled in a second tube of predetermined size and shape, of the matrix material or some other suitable material and drawn, extruded and/or rolled until the wire filaments and/or the outer tubing attain a predetermined reduced diameter and/or crosssectional shape. The rebundling may optionally be repeated one or more times, optionally after first removing the outermost tubing, whereby the new tubing is not necessarily made of the matrix material. Alternatively, rebundling can be effected in a continuous process through employing two or more tubings with their content of bundled and reduced fiber wires in matrix tubings, or by employing the contents of such tubings after first removing these tubings. The same methods of annealing are used, and cutting, shaping and etching follow as above noted.

In the absence of a barrier material, etching of the drawn and shaped brush stock of matrix and fiber materials is accomplished by selecting an etchant corrosive to the matrix material but non-corrosive to the fiber material and immersing the end of the brush stock into the etchant. Etching is performed by immersing the shaped end of the brush stock a predetermined length and in a predetermined orientation into the etchant. In a preferred embodiment etching is performed in a centrifuge by centrifuging the shaped end of the brush stock while immersed in the etchant to force etchant circulation among the wires of the fiber material to uniformly etch away the matrix material to the required predetermined length.

Centrifuging is helpful or necessary if (1) the fiber wires, with or without barrier material, are slightly attacked by the etchant, since centrifuging reduces the etching time; (2) close control of the final matrix surface is important; (3) shorter etching times are required for any reason whatever; (4) "wicking" of the etchant causes excessive localized etching, e.g. at the brush center; or any combination of these reasons. Optionally, in order to superficially protect the end of the brush stock from etching beyond the desired fiber length, and/or to aid in positioning the end of the brush stock in the etchant, a protective coating or embedment may be provided. This treatment includes coating the brush stock beyond the desired fiber lengths with a lacquer or other coating not corroded by the etchant, or embedding the brush stock in an embedment material not attacked by the etchant, such as paraffin or a plastic.

In case a barrier material is used, the etchant may be of a kind which also attacks the fiber material, but it must be non-corrosive to at least one non-porous layer of the barrier material, since in that case the barrier material will protect the fibers from etching attack. Further, more than one etching operation may be used in sequence in order to remove the matrix and part or all of the barrier material.

Different etchants may be utilized according to the invention, depending upon the particular matrix and fiber materials employed. Ordinarily, the density of the etchant enriched with ions of the matrix material becomes greater than the density of the fresh etchant and the shaped brush stock end is oriented away from the axis of the centrifuge when running. In the reverse case, in which during etching the density of the ion enriched etchant alone or with entrapped gas, as the case may be, becomes smaller than the density of the fresh etchant devoid of gas and the ions, or when accumulating gas bubbles may be a problem, the shaped tube end should point upwards while the centrifuge is at rest, i.e. toward the axis of the centrifuge while running, such that spent etchant and/or gas bubbles are effectively removed from the active surface of the matrix material during etching. It is necessary that protective fluid, immiscible with the etchant, non-corrosive to the matrix material and brush connectors, and having a specific gravity larger than that of the etchant be added to the etchant in that event, such that during centrifuging, the shaped end of the brush stock protrudes into the etchant only the predetermined length corresponding to the desired length of the fibers.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 6 and 10) being run on graphitized copper rotors; some tests (e.g. FIGS. 5, 7 and 8) on bare copper rotors; some tests (e.g. FIG. 9) on a silver plated copper rotor, it being noted that tests were also performed on gold and rhodium plated copper rotors.

DESCRIPTION OF THE PREFERRED EMBODIMENTS

Figure 1A:
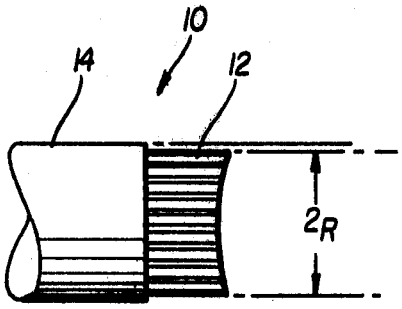
FIGS. 1*a* and 1*b* are schematic side and end views, respectively, of a multifiber electrical brush according to the invention.
Figure 1B:
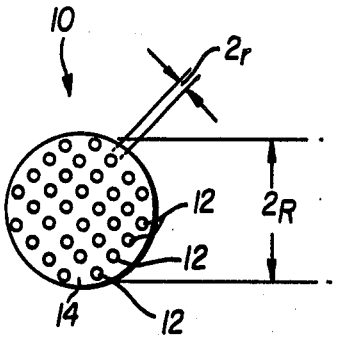

Referring now to the drawings, wherein like reference numerals designate identical or corresponding parts throughout the several views, and more particularly to FIGS. 1*a* and 1*b*, the electrical brush 10 of the invention (of rectangular, circular or other cross-sectional shape as desired) is seen to include plural microscopic fiber wires 12 embedded in and extending from a matrix material 14. The circular electrical brush 10 in FIG. 1 has a radius R, being that of the area covered by fibers after the etching, while the individual fiber wires embedded therein have a radius r, with the ratio of the total cross-sectional area of the multiple fiber wires relative to the cross-sectional area of the matrix material, otherwise known as the packing density (f), for the brush having circular cross-section represented by the following relationship:

$$f = nr^2/R^2 \quad (1)$$

where n is the total number of fiber wires.

Figure 2A:
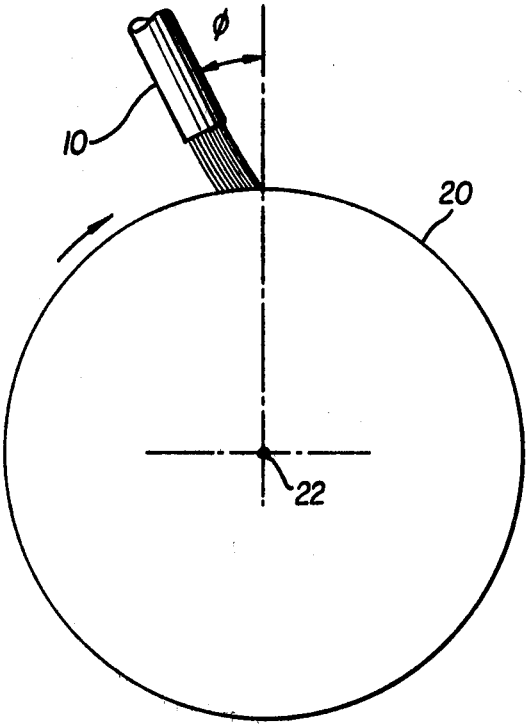
FIGS. 2*a* and 2*b* are schematic side views, respectively, of the multifiber brush according to the invention, showing possible relative positioning between the brush and an object, such as a rotor, to be contacted.
Figure 2B:
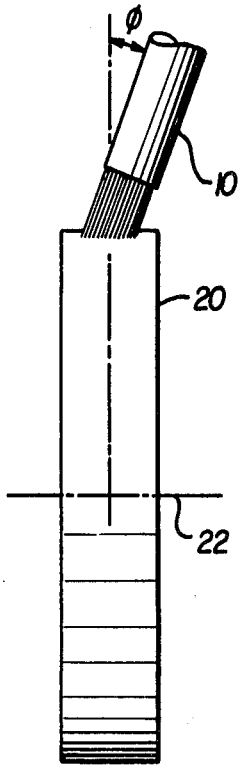

FIGS. 2*a* and 2*b* illustrate relative positioning between a brush 10 and a contacting rotor 20, the angle $\theta$ corresponding to the tangential inclination of the brush at the rotor surface relative to a radial plane containing the rotor axis 22. The angle $\phi$ corresponds to the axial inclination of the brush 10 relative to a plane perpendicular to the rotor axis and the above-noted radial plane.

In its basic principle, the objective to be achieved by multifiber electrical brushes is to provide many contact spots on a highly conductive brush at a considerably smaller force between the contact surface of the brush and the surface of an object making contact with the brush than is commonly used for monolithic brushes at same size, speed and current density. Additionally, it is desired that the brush surface provides a similarly large number of contact spots at small loads as well as large loads, and that the brushes exhibit a high degree of compliance in the direction normal to the object being contacted, such as a slip ring or commutator.

A very few simple considerations show the theoretical advantage of fiber brushes as compared to monolithic brushes. Basically, the total contact resistance between the brush and contacted surface consists of three major parts acting in series, namely the ohmic resistance of the body of the brush, $R_{OHM}$, secondly the constriction resistance $R_{CON}$, and thirdly the surface film resistance $R_F$. The total contact resistance determines the electrical loss of the brush $L_E$, at a current I according to the following relationship:

$$L_E = (R_{OHM} + R_{CON} + R_F)I^2 = R_B I^2 \quad (2)$$

The contact resistance of electrical brushes is basically controlled by the fact that only a very small fraction of the geometrical contact area between the brush and, for example, rotor being contacted (be it a slip ring or commutator) is in sufficiently intimate contact to permit the current to pass. Typically, the surface fraction which actually conducts current is much less than 1%. In order to increase that percentage, and thus decrease $R_{CON}+R_F$, which causes the bulk of the electrical loss through the brush and resultant heating since $R_{ohm}$ is typically negligible, the mechanical load on the brush can be increased. However, since $L_T$, the total loss through the electrical brushes is the sum of the electrical and mechanical losses, namely $L_T=L_E+L_M$, and since the mechanical loss, $L_M$, given by $L_M=\mu vP_B$ with $\mu$ the coefficient of friction and v the surface velocity, rises linearly with the brush load $P_B$, this possibility is severely restricted. Indeed, the total loss tends to be minimized when the mechanical and electrical losses have approximately the same magnitude.

Given the total atomistic contact area, the number of current carrying spots (the so-called a-spots) into which the contact area, and thus the current, is divided, importantly influences the constriction resistance $R_{CON}$. This is so because all of the current flow lines must pass through, and thus are constricted at the a-spots, to the effect that the individual resistance of any one a-spot is comparable with the resistance of a wire of the same material and cross-section having a length equal to the diameter of the a-spot. Correspondingly, when the total area of the a-spots is kept fixed, the equivalent length of the current constrictions is comparable to the diameter of the a-spots which, of course, shrinks as the number of a-spots is increased. Since that part of the electrical resistance of the contact, $R_{CON}$, due to this effect is proportional to the discussed equivalent length, $R_{CON}$ drops inversely as the root of the number of a-spots if these are locally under plastic deformation, and somewhat more if elastically stressed.

As a result, if the number of a-spots is increased by, for example, a factor of 100, the constriction resistance is decreased at least by a factor of 10.

The third component of electrical brush loss noted above is due to the electrical resistance $R_F$ of the surface films in between the brush and the rotor surfaces at the a-spots. This resistance is often strongly dependent on the ambient atmosphere and for that reason often protective atmospheres are used. As was shown by *Holm* (R. Holm, *Electric Contacts,* Springer, N. Y.), the film resistance accounts for more than half of the total contact resistance even under normal clean conditions and with only one a-spot. With many a-spots provided, the film resistance therefore controls the metal fiber brush resistance according to the invention.

By far, the most widely used electrical brushes of today are made out of one solid piece, i.e. they are "monolithic", and are overwhelmingly fabricated from graphite, very often admixed with metal powder in order to enhance the conductivity. It is generally considered that the graphite functions to lubricate the interface, thereby reducing the coefficient of friction and mechanical losses, and also decreasing mechanical wear. However, in monolithic brushes the number of a-spots ranges from one to only a few, so that the constriction resistance is at its maximum for any given load. Also, due to the lubrication, films are deposited which substantially add to the electrical resistance (compare Dillich et al, *Electrical Contacts,* 1979, page 185, ITT, Chicago, Ill.). Also, at best monolithic graphite metal mixture brushes have a compliance as of 100% graphite, meaning that they are always quite stiff.

Under the described conditions, a considerable improvement of brush performance as compared to monolithic brushes is possible, at least in principle, through the use of metal fiber brushes (whether or not intermixed with other fibers inserted for lubrication). The number of a-spots can be made as large, more or less, as the number of fibers, while the brush surface can be made sufficiently soft that excellent mechanical contact can be assured, even at high speed operation, by the use of much smaller loads than are needed to assure continuous mechanical contact of monolithic brushes against the rotors. In this connection, it should be noted that it is often impractical to reduce the mechanical load of monolithic brushes to the level of minimum total loss, i.e. to near equality between electrical and mechanical loss when the brush speed is high. Namely, because of their rigidity, the "bouncing" and arcing of monolithic brushes increases with velocity, and they must be held against the rotor with a force increasing with velocity for that reason. Thus, multifiber brushes overcome two important limitations characteristic of monolithic brushes, namely their rigidity and the low number of a-spots, with the corresponding lowering of electrical loss and mechanical loss.

Also, the remaining component controlling the electrical brush loss, i.e. the film resistance, can in principle be greatly reduced by the use of metal fiber brushes, namely if it is determined that the brushes can be run without lubrication, and thus their lubricating film is eliminated, leaving only those films which are unavoidably present, such as through oxidation or through water or oxygen absorption at the surfaces. Furthermore, besides the question of lubrication, increasing the number of a-spots increases the total contact area if they are elastically stressed, thus further reducing metal fiber brush resistance as compared to monolithic brushes.

In view of the above discussion, it is believed that in all respects the fiber brush, with fibers made out of metal, is very superior to the conventional monolithic graphite brushes in common use. Not only is the fiber brush ohmic resistance negligible, even if the packing density of the fiber is as low as 3%, at fiber lengths on the order of millimeters to 1 or 2 cm, but deliberate lubrication seems unnecessary or harmful. Namely, loads can be made so small that the values of mechanical loss are small even if $\mu$, the coefficient of friction, should be near unity instead of 0.2 as is typical for graphite brushes. In fact, observed values have ranged between 0.2 and 1.0 with 0.35 most frequent. In that regard, it is noted that the compliance of the brush in the direction normal to the rotor sets a lower limit to the brush load since satisfactory brush behavior depends upon the average fiber being bent into a radius of curvature somewhat comparable to the fiber length.

The requisite force per fiber to obtain a specific radius of elastic bend, at low enough packing density to permit independent motion of the individual fibers, is proportional to $d^4/L^2$, where d is the fiber diameter and L is the fiber length protruding from the matrix (see FIG. 1). As compared to the compliance of the solid monolithic brush, the fiber brush can therefore be made elastically softer by millions choosing d/L on the order of 0.01 or less, that is, fiber thicknesses on the order of 120 $\mu$m or less for fiber lengths of about 1 cm at a packing density in the order of 20% or less. Correspondingly, in addition to the need to overcome aerodynamic lift when significantly present, the brush load is definitely limited only by the requirement to keep the brush in place with at least a light elastic bending of the fibers, and can in principle be made as small as desired consistent with the above requirement. In practice, it is pointless to reduce the value of the brush load to below about 0.2 N for a brush of 1 $cm^2$ area, or so. At this load level the mechanical loss is insignificant as compared to the mechanical loss at about 8 $N/cm^2$ pressure typical for monolithic graphite brushes, while metal fiber brush wear is liable to increase when the load is too light, due to increased heating resulting from the correspondingly increased electrical resistance. The preferred dimensions of the brush thus depend on the desired current densities and speeds, and the preferred brush load is best adjusted to a value at or below that at which mechanical loss and electrical loss are equal at the highest anticipated sustained current density during use. The important point to be made here is, however, that the indicated theoretical considerations, based on fundamentals and elaborated in the course of purposeful, experimental research, permit optimization of the brush design.

An important consideration in the use of fiber brushes is the atmosphere in which they are run. Typically, contamination, especially apparently with gaseous oxygen, sulphur and chlorine, increases the electrical loss. In advanced applications, it is therefore often important to provide a protective atmosphere. Not infrequently, the addition of some moisture to these is beneficial.

Particular advantages of fiber brushes made of gold fibers, palladium fibers and platinum fibers are that they can be used in ordinary atmospheric air with little change of properties (say within±30%), as compared to their use in a protective atmosphere barring contamination of the rotor with solid particles or surface films, i.e. contamination extraneous to the fiber brushes. From these results it is inferred that rhodium fiber brushes can also be run in ambient air. Brushes made of any of these metals as fiber material thus hold great promise for a wide range of applications, and this in spite of the high cost of these metals. Specifically, as ever better brushes are being developed, the brush cost per ampere conducted is expected eventually to become considerably smaller than the cost of the electrical energy saved through their use over the lifetime of the brush. Since in principle metal fiber brushes according to the invention can be used on slip rings in virtually all machinery and devices in lieu of monolithic brushes after suitable modifications of the brush holders, provided that they can be run in air, it is expected that metal fiber brushes according to the invention will in due course displace monolithic brushes in all applications in which the cost of the energy dissipated in the brushes is of importance, e.g. in commercial power generation. This is so even if metals made of gold, platinum, palladium and/or rhodium are used for fiber materials, although other less expensive materials are also excellent candidates at this comparative early stage of metal fiber brush research and development.

According to the results of numerous tests with metal fiber brushes according to the invention, thin continuous surface layers on copper rotors, such as platings with rhodium, silver and gold, and such as provided by graphitizing, essentially impart to the rotor the electrical characteristics of the plated-on material. It is anticipated that the outermost layer of a barrier material on the lateral and/or end surfaces of the exposed parts of the fibers will affect electrical fiber brush performance in a similar manner with respect to the fiber material and the outermost barrier layer, while the mechanical properties of the fibers will remain substantially those of the basic fiber material. For selected cases, theoretical considerations indicate substantially reduced electrical loss when the brush fibers are provided with an outermost barrier layer which exhibits lower film resistance in use in conjunction with a contact, e.g. rotor of a particular material, than is realized with a bare metal fiber susceptible to the formation of higher resistance films when alone used in contacting with the same contact material. Correspondingly, it is envisaged that outermost barrier layers of, say, silver, copper, gold and platinum group metals on the exposed parts of fibers such as, say, of stainless steel, titanium, tungsten or nickel will permit at least partially combining the electrical properties of the named barrier and fiber metals while maintaining the strength and wear properties of the underlying fibers. Multiple barriers will often be needed to put that principle into operation, however, in order to prevent the dissolution of an outermost barrier layer in the matrix during hot-forming and/or intermediate anneals, and/or its dissolution in the fiber during subsequent use, especially at high current densities when the temperature at the fiber ends typically rises well above the ambient, say to 180° C., more or less. The principle involved may be demonstrated by the example of a barrier material consisting of a nickel layer over a gold layer over a nickel layer on copper fibers in a copper matrix, wherein the outermost nickel layer is etched off before use of the brush. The above examples are given to demonstrate the principle and are not meant to be inclusive.

It is further noted that theory indicates most, and perhaps all, metal fiber brushes to run better at reduced atmospheric pressure or in vacuum, since thereby both atmospheric lift and surface film resistance are reduced. The metal fiber brushes according to the invention are thus excellent candidates for use in space and high flying aircraft, especially since graphite-based brushes do not perform satisfactorily in vacuum.

Limitations of useful fiber diameters derive from two sources. Firstly, whether deliberate lubrication is used or not, the air current about the rotor will prevent the fibers from contacting the rotor surface if the brush surface is too compliant. Secondly, if deliberate lubrication is used, one must suspect that too thin brush fibers, pressing against the rotor with insufficient force, will not penetrate lubricant surface films. Much the same is true for extraneous surface films such as are commonly formed under not very clean conditions. A third potential limit, namely that the a-spots should have a diameter larger than the mean free path of the conduction electrons, is probably of secondary importance, except perhaps at low temperatures Since either of the two former considerations make fiber sizes below one micron or so impractical under almost all conditions.

In light of the above, basic theoretical considerations suggest that metal fiber brushes with fiber diameters between 1 and 120 μm, preferably between 3 and 60 μm, and most usefully for the majority of applications between 6 and 50 μm, having lengths on the order of one millimeter to approximately 2 cm, and with packing densities varying between 1 to 20% (or perhaps moderately higher depending on the friction between neighboring fibers), preferably between 2.5% and 18%, should exhibit improved performance, provided that they are properly constructed and operated. In that regard, the requisite operating conditions should include a light mechanical loading well below that employed for monolithic brushes under otherwise same conditions, and about equal to or less than that which causes equality between electrical and mechanical loss at peak operational current density.

Regarding construction, one usually prefers the highest packing density compatible with good compliance, except when considerations of cost intervene as in the case of noble metal fibers, in order to attain low losses and high peak current densities. Thus, one prefers to reduce friction among the fibers since otherwise the brushes will not permit the fibers to flex individually, which strongly suggests smooth, straight, and evenly spaced fibers. It should be noted here, however, that once a brush is placed on a rotor, it may exhibit excellent performance even if loaded well beyond its macroscopic yield point so that the fibers mat together and the brush running surface appears almost solid. In fact, excellent results have been obtained in this mode of operation (see FIG. 6).

Again, it depends on current density and speed what parameters of brush construction and operation are chosen. Evidently, even if they are macroscopically compacted, metal fiber brushes may retain much local pliability, leaving a very large number of a-spots operative, with the commensurate excellent performance. Whether the individual a-spots are elastically loaded (as seems to have been the case in experiments analyzed to date) or deformed plastically is not critical for the performance of the brushes except that wear rates may be affected. In cases in which brushes may have to be removed from rotors or other contact surfaces intermittently, and in which brushes undergo sideways displacements during use, brush loads beyond the macroscopic plastic limit are inadvisable, however, because (it appears on account of insufficient remaining pliability), brush performance of such matted brushes is significantly impaired by even minor changes of their alignment against the contacting surface. On each replacement or relative sideways motion the brush load of brushes run in plastically deformed condition must be raised to restore the earlier excellent performance. This kind of behavior is not observed with elastically loaded fiber brushes. Relative insensitivity in regard to misalignment of brushes is considered to be an important advantage, and elastic brush loading is preferred before macroscopically plastic loading for that reason, besides the fact that minimum wear appears to occur in the elastic range.

The choice of materials is subject to different important considerations, dependent on whether fibers, barriers, or matrix are concerned. The primary consideration in regard to fiber materials, or barrier materials in the event that a barrier layer is provided on the exposed part of the fibers, is that they should offer a low contact resistance when run against such surface materials as are commonly used in electrical contacts, including but not restricted to copper, silver, gold, rhodium and noble metal alloys. This property cannot readily be forecast since in the case of fiber brushes it is dominated by film resistance and the detailed properties of the films are still far beyond the scope of present theoretical understanding. Thus, for example, data gathered to date indicated that the film resistance of platinum fibers running on a silver rotor is considerably smaller than when running on gold, and when running on silver is smaller in atmospheric air than in an argon atmosphere. If exhibiting sufficient conductivity, barrier layers of carbon could remain on the fibers, as also remnants of organic barrier materials if they were graphitized during brush manufacture.

Secondly, it is highly desirable that fibers have high mechanical strength so that they (i) are able to sustain the loads imposed on them without undue plastic deformation, in accordance with the previous discussion of this point, thus preserving the elastic compliance of the brush even at low packing densities, (ii) are not subject to premature fatigue failure in use, and (iii) have long wear life.

Deformability so as to simplify manufacture of the brush stock is a very important consideration in selecting a fiber material. Copper, for example, can be formed from bars into wires without intermediate anneals at room temperature, whereas iridium lies at the other extreme of deformability, defying attempts at deforming it to any significant degree at ambient temperature. A fourth consideration is chemical and thermal stability at ambient atmospheric conditions, and/or chemical stability in the atmosphere to be used up to the temperature of at least 150° to 200° C., since these temperatures are typically encountered, at least locally, during the use of fiber brushes, including that the fibers must be solid up to those temperatures. If such stability is not present in atmospheric air up to about 200° C., protective atmospheres or protective or cooling liquids must certainly be used, thereby greatly adding to the costs. An example here is niobium, which can be used in connection with liquid sodium and potassium and indeed is an excellent fiber material for that purpose, but which is pyrophoric in small fiber diameters when used in air.

A fifth consideration is cost. This clearly discourages the use of noble metals when other options are available. However, for high technology applications when high performance and/or reliability are mandatory, the cost of the fiber material may be judged insignificant as compared to the prior considerations of film resistance, resilience, durability against fatigue and wear, and chemical stability, or any combinations of these. Besides, as pointed out already, prospects are that noble metal fiber brushes will be made to save more than their cost in the form of reduced energy losses over their projected lifetime.

Lastly, one may mention that a high melting temperature is desirable, all else being equal, since the attainable current density is certainly limited to that at which the fiber tips begin to melt. This consideration favors rhodium and platinum over gold and silver among the noble metals, and further is a reason why iron and steels, and nickel, tungsten, titanium and their alloys are useful fiber materials.

In the above partial list of fiber candidate materials, tungsten, having the highest melting temperature among all metals, is unique in that it is readily available in the form of very thin wires which is a very attractive feature since tungsten is difficult to deform. The reason why, in the case of tungsten specifically, the necessary technology for the formation of very thin wires in large quantities has been previously developed is its wide use for filaments in lamps and electronic equipment as well as in fiber reinforcement materials.

Summarizing, fiber materials made of noble metals, Ni, Cu, Fe, W, Ti, and high concentration alloys (i.e. 70% or greater by weight of one or more of the listed elements) are suitable for use in the brush of the invention.

The mandatory properties for matrix materials are less stringent than for fiber materials. While the matrix must have adequate electrical conductivity, the relevant length and cross-sectional area of the matrix are usually large enough so that its ohmic resistance is negligible compared to the film resistance even if its resitivity is fairly poor. This is exemplified by the fact that carbon, a non-metal, is an acceptable matrix in monolithic brushes and would be acceptable as a matrix material also for many fiber brushes, as indeed would be other non-metals, e.g. molybdenite, on the basis of electrical conductivity alone. The most important considerations in the selection of the matrix material from among the wide range of substances with adequate electrical conductivity is deformability, preferably at ambient temperature and with fairly low annealing temperatures, with good chemical stability, differential etchability, and low cost, in that order. In regard to chemical stability, most of the common metals with melting points above, say 150° C., would be acceptable, including even niobium. Still, as for fiber materials so also in the case of matrix materials, many metals are ruled out as the major matrix constituent on account of insufficient chemical stability and/or low melting points. Mercury, sodium and potassium are examples here.

Altogether, the mentioned properties desired for matrix and fiber combinations may be so difficult to meet in specific cases that the choice cannot be restricted to pure metals, but must be expanded to include a wide range of alloys, if one does not want to preclude the development of the best possible metal fiber brushes for a host of applications. A variety of metals which by themselves are unsuitable for both matrix and fiber materials will almost certainly be important alloying constituents in either the fibers, or the matrix, or both. For example, measurements made with fiber brushes on copper alloy rotors indicated small additions (<5%) of zirconium to copper fibers will substantially enhance their mechanical properties without significant loss of electrical performance, whereas zirconium by itself will probably not be useful for fiber brushes. This further suggests the use of small additions of ruthenium and/or iridium, among other possible choices, to gold used to make fiber wires, to enhance the strength and wear resistance of gold fiber brushes. Namely, in spite of their excellent performance (as demonstrated in FIGS. 6 and 10), wide-spread use of gold brushes will probably depend on their wear characteristics being significantly improved.

Manganese will be an essential constituent in most metal brush fibers based on steels, stainless or otherwise, but will not be used by itself on account of its brittleness. Yet, on account of their excellent mechanical properties, high melting temperatures, and relatively low cost, fibers of nickel, iron, and steels are liable to become important, and in this regard titanium should be strongly considered also, in spite of the fact that little is known about the film resistivities of these metals.

The reason that differential etchability is placed after electrical conductivity, deformability and chemical stability in the choice of matrix materials does not mean that it is unimportant. Indeed, without it, metal fiber brushes according to the invention can be barely made made at all. As a general though not entirely stringent rule, the etchability of the matrix metals improves the lower down they are placed on the electrochemical series. Thus aluminum, iron, and zinc are favored candidate materials. Magnesium would be especially favorable in this regard but poses the problem of being flammable. It is evident from this consideration that lead would be a poor candidate material for the matrix since it is comparatively noble. However, one potential method of making brush stock is infusion of the fibers with molten matrix materials, and in this method lead and solders would be among the most likely choices. Alternatively, it is possible to remove the matrix not by etching but by dissolution in case the matrix should be a non-metallic conductor, or by melting in case of an adequately low melting temperature of the matrix. Neither of these options is definitely ruled out in this invention. However, lack of differential etchability rule out of consideration the noble metals, exclusive of silver.

Etchability has been placed fourth among the desirable properties of matrix materials, not because of an overly wide choice of matrix materials, but because of the anticipation that barrier materials can be derived for a host of fiber and matrix combinations which will overcome the difficulties that otherwise would be encountered in regard to etching, and which would indeed very seriously otherwise limit the range of metal fiber brushes that could be made. This conceptual point is demonstrated by the example that copper fiber brushes can be made with a copper matrix by the use of an aluminum barrier (compare FIG. 8 and the table of etching solutions).

The barrier materials serve a very useful function in addition to the one in regard to etching, namely, as variously mentioned, to retard the dissolution of fibers in the matrix during brush manufacture. In order to similarly inhibit the dissolution of layers of barrier materials into the matrix and/or the fibers, multilayer barriers are envisaged as essential. Thus, for example, it is planned to protect barrier layers of gold from dissolution in copper by barrier layers of nickel, gold being an excellent barrier candidate material for permitting differential etching of the matrix.

The example of gold as a barrier layer illuminates yet two further intended functions of some barriers, namely of increasing the chemical stability of the fibers after etching away the matrix and/or of reducing the film resistance, thereby enhancing brush performance. In order to fulfill either or both of these functions, the barrier layer in question must remain on, or be applied to, the fibers after etching away the matrix. In the case of gold and metals of the platinum group, if used as a barrier or part of a barrier within the matrix, it is virtually a foregone conclusion that they will not be etched off. Namely, on account of its nobility, gold, for example, can be etched away only from still more noble fibers, especially platinum fibers, or any other type of fiber only if a non-porous still nobler than gold barrier underlies the gold. Since in each of these cases platinum only, say, would remain at the fiber surface, after etching off the gold, and since platinum does not foreseeably require any protection by gold, such a combination would seem pointless. Thus, it is anticipated that whenever gold is used within the matrix as part of a barrier, it will remain on the fiber material after etching. The same holds true for metals of the platinum group. If desired gold, as many other metals, may be applied to the protruding fibers after etching.

The above discussion illuminates a further consideration in regard to the choice of barrier materials, namely that gold and metals of the platinum group must be avoided unless it is desired that they remain on the fiber as its ultimate surface material. Correspondingly, when one intends to make a brush of thin silver fibers in a copper matrix (compare FIG. 7 and the table of etchants), a gold barrier cannot be used to overcome the problem of differential etching since the gold could finally not be removed. Another barrier material, not necessarily of one layer, must therefore be devised in the case of thin silver wires in a copper matrix to permit differential etching of the matrix unless a more selective etchant than listed in the table should be developed.

Figure 8:
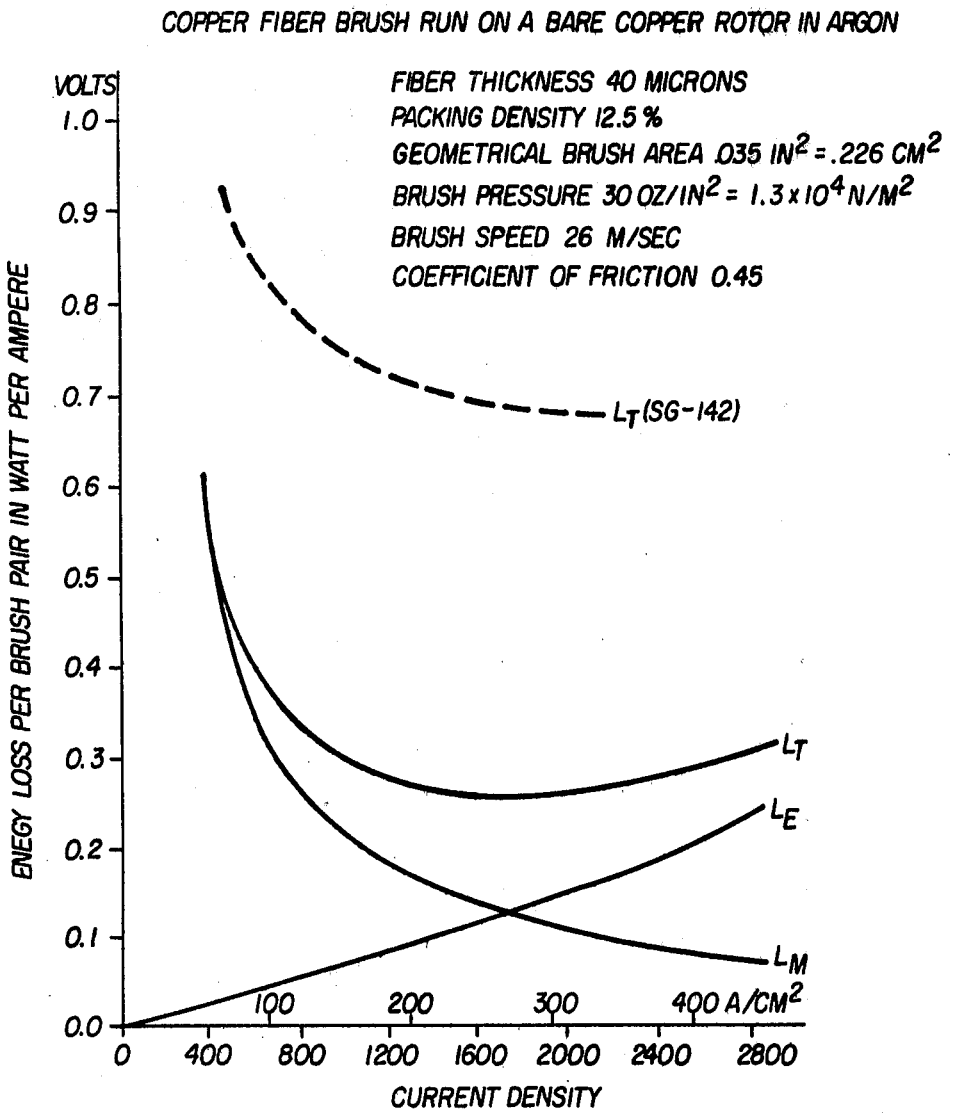
Figure 9:
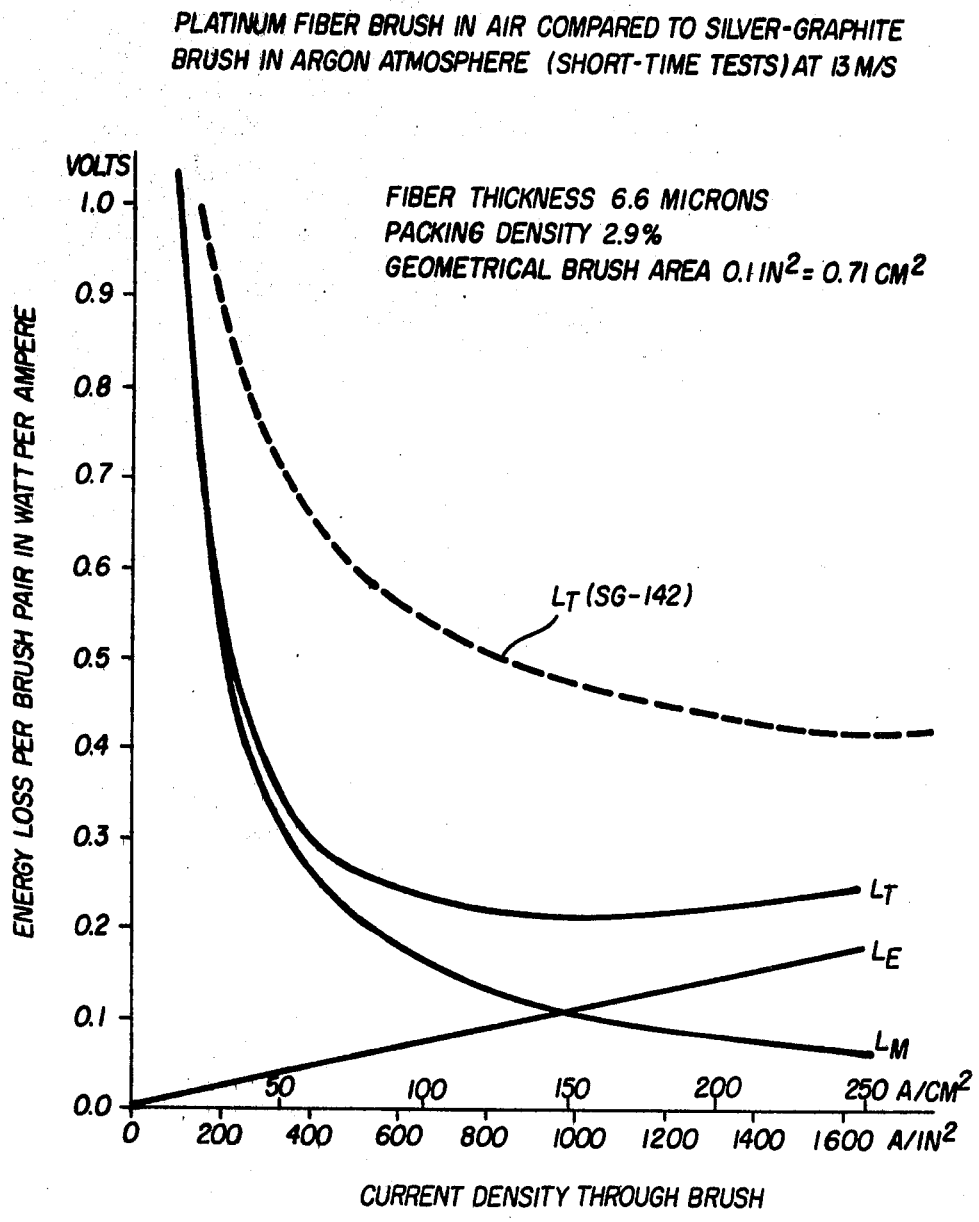

Platinum and/or gold surface layers on the fibers protruding from the matrix are liable to be used widely. It is envisaged that brushes with fibers of stainless steel, other steels and/or nickel, for example, provided with a gold or a platinum barrier will show imroved performance when run on selected contacting surfaces, e.g. silver. The example of nickel in combination with platinum brings up another point: as seen in FIG. 9, platinum fiber brushes are ver promising in spite of the fact that typically the film resistance of platinum is fairly high. This is due to the high strength and high melting point of platinum. As shown by Holm (R. Holm, *Electric Contacts,* Springer, New York, e.g. FIG. 8.01), crossed contacts of nickel rods have similar contact resistances in air as those of platinum, and also the hardness and melting temperatures of nickel and platinum are similar. Besides, as is known from nickel platings, nickel has excellent chemical stability. It is therefore held probable that nickel fiber brushes will become very useful.

Returning to the possible use of a barrier to permit etching thin silver fibers out of copper, note that in that case etching the matrix would leave an unwanted residue of the barrier on the fiber consisting of at least one non-porous layer, or perhaps two very slightly porous layers in combination. That residue would then need to be etched away from the fibers extending from the matrix. Such etching could be done in the centrifuge or by dipping into a suitable etchant. Namely, with the matrix already removed from the essential, fibrous part of the brush, and the envisaged barrier layers being only very thin, the discussed etching away of the barrier residue is by far simpler than etching away the matrix. This second etching step could be speeded up by using ultra sound. At any rate, it is not necessary to protect the brush stock from the second etchant unless it should be highly corrosive to the copper matrix, but it is essential that the second etchant not be corrosive to the silver fibers.

A further use of multiple barriers and the etching requirements arising therefrom can be demonstrated by expanding upon the preceding example of etching thin silver fibers out of a copper matrix. Namely, provided that thin surface layers will indeed prove to enhance brush fiber properties as anticipated, it would be advantageous to use thin silver barriers on strong, resilient fibers such as say, titanium, among a wide choice of metals suitable for that purpose. With expected costs being higher when plating is done after the etching step, one would thus endeavor to devise a multiple barrier, including a silver layer designed to ultimately remain on the fiber. However, after etching away the copper matrix, silver could not be the outermost layer as desired, since it would have to be protected by a barrier layer during etching of the copper matrix. Therefore, in the second etching step only the outermost part, but not all, of the remaining barrier would need to be etched away so as to finally yield a copper matrix brush with silver covered titanium fibers.

Besides the already discussed requirements, it is necessary that the barriers have adequate deformability and that they may be applied on the fibers to the requisite thickness in reasonable periods of time. Both of these conditions pose potential problems and thus they put a premium on methods that permit one to start the process of brush stock manufacture with as thin fiber wires as can be conveniently handled and are not unduly expensive. The herein disclosed method of making the brushes by first coating fiber wires (with or without a barrier) with matrix material before placing them into tubing, optionally together with matrix wires, and then drawing, bundling, shaping, and etching as outlined above, was designed with this problem in mind. Namely, while it is typically possible to speedily deposit thin layers of materials on long lengths of wires, e.g. by plating loosely wound spools or tows, etc., the deposition of thick layers typically requires times proportional to the layer thickness, largely independent of the area to be covered. In the method of the invention, therefore, after plating onto very thin (e.g. in the order of 100 $\mu$m thick) wires of fiber metal, the desired barrier material, a layer of matrix material is deposited, which may or may not be done on the same spools or tows, as convenient or desirable, thereby preventing subsequent direct contact between adjacent fiber wires, while at the same time strengthening and thickening the fiber wires as is often desirable for the subsequent steps of brush stock manufacture. The method has the additional advantage that is requires much less plastic deformation of fibers and barriers to achive brush stock with the same ultimate fiber wire size than if one begins with thicker fibers. Correspondingly, the latter method according to the invention permits or simplifies the manufacture of electrical fiber brushes with fibers and/or barriers of marginal deformability.

Altogether it is clear from the above considerations that the widest possible latitude in the choice of fiber, barrier and matrix materials is mandatory for the intended development of the best possible metal fiber brushes designed for a wide diversity of anticipated applications with their wide diversity of needs. These needs include the requirements of: low loss per ampere conducted in stationary contacts or contacts in relative motion, high peak current density, high relative speed of slip rings, long brush life, minimal sparking and arcing, low noise, high reliability small dimensions, easy application, simple replacement, operating capability in vacuum and a variety of atmospheres, operating capability in fluids, operating capability in corrosive surroundings, and/or operating capability outside of the usual range of temperatures, and any combination thereof, to name the most pressing needs that are met from case to case-without even mentioning cost, since it is expected that ultimately in the majority of cases the overall cost of using metal fiber brushes will be lower than for any other brushes fulfilling the same requirements. It might be added that at this point no satisfactory brushes are available at any cost for a variety of the problems alluded to. As a consequence, some technological developments are stalled as mentioned already, while as demonstrated for example, in FIGS. 5 to 11, at least some characteristics of the restricted number of metal fiber brushes made so far greatly surpass those of the best previously available brushes.

With the above considerations in mind, several different types of multifiber electrical brushes according to the invention have been manufactured, namely using fiber wires of platinum, gold, palladium, sterling silver or niobium embedded in a copper matrix, and using gold fiber wires in a silver matrix, with the fibers having a diameter varying from several to 120 μm, a length diameter ratio of larger or equal to 50, and a packing density between 3 to 20%. Similarly dimensioned brushes were made of copper fibers with an aluminum barrier in a copper matrix. Also, the teachings of the invention are applicable to multifiber electric brushes using metal fiber wires embedded in an aluminum matrix material. Copper metal fibers have been found suitable for that purpose.

The manufacture of the above-described multifiber electrical brushes is now described. In its simlest form, the manufacturing method of the invention begins with a suitable multi-filamentary material formed of a matrix material having embedded therein plural fiber wires dimensioned as noted above, whereupon the contour of the future brush is shaped by mechanically shaping one end of the multi-filamentary material to the desired composite shape of the brush fiber ends in the manner described above, including the possible provision for non-uniform fiber deformation. Thereafter, a length of matrix material corresponding to the desired length of the individual brush fibers is etched away, leaving the exposed brush fiber wires.

In order to obtain suitable multi-filamentary in the laboratory, various approaches were considered as described in Adkins and Kuhlmann-Wilsdorf, *Electrical Contacts,* 1979, Ill. Techn., Chicago, Illinois, including the utilization of commercial superconductor multi-filamentary materials, or the separate manufacture of multi-filamentary materials using the techniques employed in the superconductor industry, or the possibility of making the required samples in he laboratory by extruding, swaging, rolling and/or drawing down suitable materials which are fine mixtures of the intended matrix and filamentary metals, or the use of polycrystalline whiskers of iron or nickel infiltrated with another material. For various reasons, each of these approaches upon further consideration has been found suitable for deriving, in a laboratory without much equipment, suitably dimensioned multi-filamentary materials as required for making the electrical brush according to the invention.

Perhaps the initially most tempting of the above techniques found unsuitable for making the electrical brush of the invention is to take commercially available multi-filamentary materials otherwise used in super conducting machinery and to etch out the matrix to expose the super conducting filaments and hence to produce the resultant exposed brush fibers. However, the commercial super conducting product is ill-suited for metal fiber brushes, being typically of too small a cross-sectional area, much too high a packing density, incorporating metal shields of a third material, with twisted fibers incapable of independent motion, and fibers made of unsuitable material, or any combination of these features. However, several brushes with twisted niobium fibers were made in this manner and tested. Ultra sound was used to perform the etching. These brushes were unsatisfactory due to the fiber twist and the pyrophoric nature of the fibers.

The requisite etching away of a matrix material from multi-filamentary materials of large diameter with very thin closely spaced fibers using previously known methods is satisfactoy only for exposed fiber lengths not very much larger than the fiber spacing. The scientific reasons why the noted etching away of matrix material from among thin, densely spaced fibers to a predetermined smooth level is slow and often very difficult are two-fold. Firstly, capillary forces interfere with etching to a smooth well-defined level if the etchant surface is either depressed or drawn up on outer and inner surfaces of the etched body (in the latter case commonly referred to as "wicking") depending on local composition and possible contamination. The height of the irregularities of the etched front derived from this action is inverse to the gravitational force. In a centrifuge many "g's" are supplied and the height of the irregularities is correspondingly reduced. Secondly, the circulation and/or diffusion of the etchant among the fibers is slowed on account of the too narrow passages available among the fibers. This circulation and/or diffusion is driven by concentration gradients as the etching solution becomes enriched with the ions of the dissolved matrix. The principal mechanism by which circulation currents are driven under such circumstances is convection by gravity since the ionenriched etchant tends to have a greater specific gravity than fresh etchant, or in some cases might indeed even be lighter. Furthermore, not infrequently gases, specifically often hydrogen, are developed which form bubbles rising upwardly in the liquid through gravity. With too densely packed multi-filamentary materials, convection is more strongly impeded due to too narrow passages than diffusion, and the escape of gas bubbles is similarly strongly hindered. Consequently, etching slows down greatly with diffusion rather than convection becoming the rate-controlling process. For very densely spaced fibers this is expected to occur once the protruding fiber ends or the layer thickness of bared parallel fiber lengths become several times larger than the size of the average fiber spacing. Furthermore, etching is further complicated, if not made impossible, where metal shields of a third material not attacked by the etchant were used in rebundling, and not removed on subsequent rebundling, so that these shields are left in the multifilaments surrounding tubular elements of the matrix material and enclosed fiber bundles, thereby blocking etchant access to the matrix material within the bundles. Pursuing this problem in the case of niobium fibers in a bronze matrix encased with intermediate tantalum shields, the application of ultrasound during the etch was found to be most helpful.

Faced with the above difficulties, the method of the invention is designed to prepare metal fiber brushes of variable packing density and fiber diameter wherein there is almost no limit to the packing density and fiber sizes. According to the invention, fibers can be made a few microns thick or perhaps even less than 1 μm, and the packing density can be readily varied between less than 1% and 10's of percent, typically between 2.5% and 20%. Similarly, fiber lengths can be varied within very wide limits. Including the use of barrier materials, the choice of materials for fibers and matrix is very wide and limited only by the need for adequate plastic deformability, chemical stability, melting temperatures above about 150 to 200° C. for the matrix and above 200° C. for the fibers, and the availability of selective etching agents suitable for removing matrix material between the fibers without significantly attacking the fibers or at least one non-porous layer of the barrier material surrounding them, in agreement with the discussion on materials choices presented hereinabove.

In one, first, method of the invention to produce brush stock in the laboratory, mixtures of wires of the desired fiber material with or without barrier material, and wires of the matrix material are placed into tubing of the matrix material and drawn down until the fiber diameter has attained a predetermined size, interposing annealing treatments, if any, as needed to prevent cracking. If required, once the tube with the enclosed wires has been reduced to a size to make further drawing awkward or impractical, the drawn down tube can be cut and rebundled one or more times and redrawn with intermediate anneals as desirable or needed until both the fibers and the brush stock have attained their respective desired diameters. Thereafter, one end of a piece of the so-formed brush stock is shaped to be flat or curved to conform to the radius and relative position (i.e. attack angles $\theta$ and $\phi$ shown in FIGS. 2*a* and 2*b*) of some rotor or other object to which the finished electrical brush of the invention is to make contact. In the particular method actually used, this shaping was done on a lathe. Then the matrix material is etched away to expose the fibers to the desired length, by dipping in etchant or using improved etching techniques according to the invention as described in more detail hereinafter. In some future industrial manufacture of brush stock by the described basic method, it is envisaged that rolling and/or extrusion will be used partly or completely in place of drawing, and/or that rebundling will be used less, and/or that lengths used will be much longer, and/or that rebundling will be done in continuous operations. It is envisaged that in a variant of future industrial manufacturing by the same basic method, the fiber wires with or without a barrier material, and/or the drawn down elements incorporating matrix and fiber wires used in rebundling, will be inserted into two or more parallel axial holes of a cylindrical or prismatic piece of the matrix material, with or without an outer sheathing of a different material, instead of being inserted into tubing. The optional outer sheathing of a material other than the matrix is meant to overcome problems that might be encountered due to surface properties of some potential matrix materials, namely that they "gall", or are unduly strongly oxidized during hot forming, or tend to wear down dies too fast, and others.

According to the above first embodiment of the method of making stock of the invention, if the wires are too thin to permit individual regular placement in the tubing, they will be randomly distributed in the final composites, i.e. except at very low packing densities, statistically fibers will be in close contact with one or more fibers of the fiber material. This is disadvantageous. On the other hand, for wires that can be regularly placed, this first embodiment may in cases be cheaper than a second embodiment outlined below, and in that case it is especially advantageous when beginning with wires of hexagonal cross-section.

According to the second embodiment of the invention to produce brush stock, preferred in laboratory practice, a rod or wire of the desired fiber material is firstly placed in tubing of the matrix material and drawn down to a convenient size prior to cutting and bundling and redrawing which may be followed by several more rebundling and drawing operations. Again intermediate anneals may be interposed as desirable or needed and, again, in future commercial manufacturing, rolling and/or extrusion are envisaged as substituting for drawing, partly or completely. What are such convenient sizes depends upon the specific modes of plastic deformation used, the ultimate fiber size and brush stock size desired, the choice of materials, the availability of tubing, etc. Typically, in the present laboratory technique, the pieces are cut into suitable lengths of approximately 50 cm and then repacked into matrix tubing of about ¼" outer diameter and successively redrawn until the fiber diameters attain the requisite size at the desired size of the finished brush stock.

According to the above second method of making brush stock, in which each metal fiber is first encased within matrix tubing, there is realized the advantage that each fiber will certainly be physically separated from all other fibers after etching. In some future commercial production using this second basic method of making brush stock, it is envisaged that extrusion and/or rolling will be used partly or completely in lieu of drawing, and/or that rebundling will be used less, and/or that lengths used will be much longer, and/or that rebundling will be done in continuous operations. It is envisaged that in a variant of future industrial manufacturing by this second method, the fiber wires with or without a barrier material, and all the drawn down elements incorporating matrix and fiber wires used in rebundling, are inserted into two or more parallel axial holes of a cylindrical or prismatic piece of the matrix material, with or without an outer sheathing of a different material, instead of being inserted into tubing. In the laboratory this latter method has been proven to be successful by the use of a turkshead as discussed below. Again, if the matrix material should "gall", or be unduly oxidized, or wears down dies too fast, or exhibits any other problem that may be due specifically to its surface properties, a sheathing of some other suitable material can be used.

The choice between the first and second methods will largely be made on the basis of the deformability of the fiber, barrier and/or matrix materials to be used, since in the first method the beginning wire size can be much smaller than in the second method. In the second method the beginning fiber wire size will typically be at least a few millimeters. Correspondingly, it is often not conveniently, economically and/or technically possible to make fiber brushes according to the invention by means of the second method if the fiber material has poor deformability, e.g. as is the case with rhodium, iridium and tungsten, for example. For such fiber materials it is thus very advantageous to begin with wire sizes below those required in the second method. Similarly, it is very advantageous to begin with small fiber wire diameters when a barrier material is to be applied so that, firstly, the initial barrier thickness need not be overly large and that, secondly, the demands on the deformability of the barrier material can be kept down. However, the most serious disadvantage of the first method, namely that at any but very low packing densities, fiber wires will statistically lie together and thus may lose their individual flexibility, discourages the use of the first method, as also the difficulty of handling very thin wires.

The following third embodiment of making brush stock of the invention, that was already briefly discussed above, overcomes these difficulties partly or completely. In this third embodiment, wires of the fiber material, with or without a barrier material, are coated with a layer of the matrix material before being placed into tubing of the matrix material together with wires of the matrix material, after which the procedure is the same as in the first method. Optionally, the fiber wires, with or without barrier material, are coated with the matrix material to a thickness as to amount to the full intended volume of the matrix material at the first stage of packing into the tube, thereby permitting to eliminate the wires of the matrix material which otherwise are mixed with the fiber wires and placed into the first tubing. The procedure from then on follows that of the first method in all respects. Also, the adaption to industrial production methods are those discussed already for the first method.

With regard to the details of the drawing, cutting and rebundling steps, it is noted that the practical implementation depends on the materials used. Generally, in the laboratory technique, the tubing should be a little shorter than the fibers to begin with, since in the first draws, and before the fibers have been fully compacted, the tubing will stretch more than the fibers.

Depending on material, intermediate annealing will typically be necessary in the laboratory as well as in future industrial practice unless hot forming is used. The temperature and time of annealings should be adjusted to give adequate softening, but unnecessarily long anneals at too high temperatures may give rise to excessive grain growth and interdiffusion between matrix and fiber material, both of which are undesirable. Correspondingly shorter anneals (say, between 2 and 20 minutes for any one segment of stock) at mildly higher than the typical lowest annealing temperatures are in principle more desirable than long anneals. These facts are important also when substituting extrusion or rolling at elevated temperatures for rolling or drawing at ambient temperature, in that they restrict the use of extrusion and other types of hot forming, except if the fiber and matrix materials are very little soluble in each other. In order to lessen such restriction in any one case, a barrier material may be used, not necessarily of one layer only, so as to inhibit interdiffusion.

From this viewpoint the combination of rhodium fibers in a silver matrix offers an outstanding opportunity for the construction of high performance metal fiber brushes according to the invention. Namely, silver (as intended matrix) and rhodium (as intended fiber material) are practically insoluble in each other so that use of elevated temperatures in annealing and/or hot working in extrusion and/or rolling would not pose any problems in regard to interdiffusion. At the same time rhodium is one of the best contact materials known and it is quite strong but it has only very limited deformability at about room temperature, so that hot forming and/or frequent annealing will have to be used in the production of brush stock with rhodium fibers. Further, rhodium (i) has an even higher melting temperature than platinum, (ii) while even more expensive than platinum per ounce, is less dense so that its cost in brushes would be similar as for platinum, (iii) as a noble metal is expected to perform in air much as platinum, (iv) unlike platinum is not known as a highly catalytic metal so that bothersome polymer formation at the fiber/contact interface is less probable than in the case of platinum fibers, (v) is likely to show little wear, generally comparable to that of platinum fibers, (vi) should have especially good wear if silver contact surfaces are used in conjunction with rhodium fiber brushes because the discussed immiscibility between rhodium and silver will minimize welding and adhesive forces. This last point is especially useful in view of the generally excellent properties of silver platings on electrical contact surfaces.

Regardless of fiber material used, the range of reduction in area of the wire fibers between anneals can be increased by rolling, as compared to wire drawing. This is so because in all drawing strong tensile stresses typically arise about the center of the drawn wire or rod so that, as is well known in metallurgical practice, cracking as a result of overdrawing begins in the center, a fact that was also repeatedly observed in the manufacture of brush stock in the laboratory. This occurs because a substantial part of the pulling force is expended to overcome the friction between the surface of the rod or wire and the die. That part of the pulling force is strongly reduced or eliminated in rolling, leading to a redistribution of stresses and to a reduction of pulling force, or even its elimination, in rolling. However, rolling, whether done in conventional rolling mills or in a turkshead, tends to repeated burr or wire edge formation where the individual rolls meet, whereby the outer casing or tubing, as the case may be, is locally thinned, and this may lead to premature breaking of it. Also, in a turkshead as well as a wire rolling mill, the deformation is non-uniform over the cross-section which leads to the corresponding unwanted distortion of the filaments in the brush stock, especially near the burr or wire edge. These difficulties can be ameliorated by rolling, in a turkshead, a square shape in which one or more cylindrical axial holes have been drilled, not in too close proximity to the expected position of the burr, into which the wire fibers after their first bundling, or after any other bundling operation, can be inserted, with or without outer tubing. The subsequent reduction of the rectangular bar with the inserted wire fiber assemblies via rolling in the turkshead leads to acceptably distortion-free diameter reductions of the wire fibers and permits a much greater reduction of area between anneals than possible with simple wire drawing. This method has been found to be very helpful in the production of palladium brushes and is expected to be helpful with any material, whether fibers or matrix, that does not cold-draw well. The same method, suitable adapted, can doubtlessly be used also in wire rolling, and it is envisaged that it will be useful in industrial brush stock manufacture.

Figure 3:
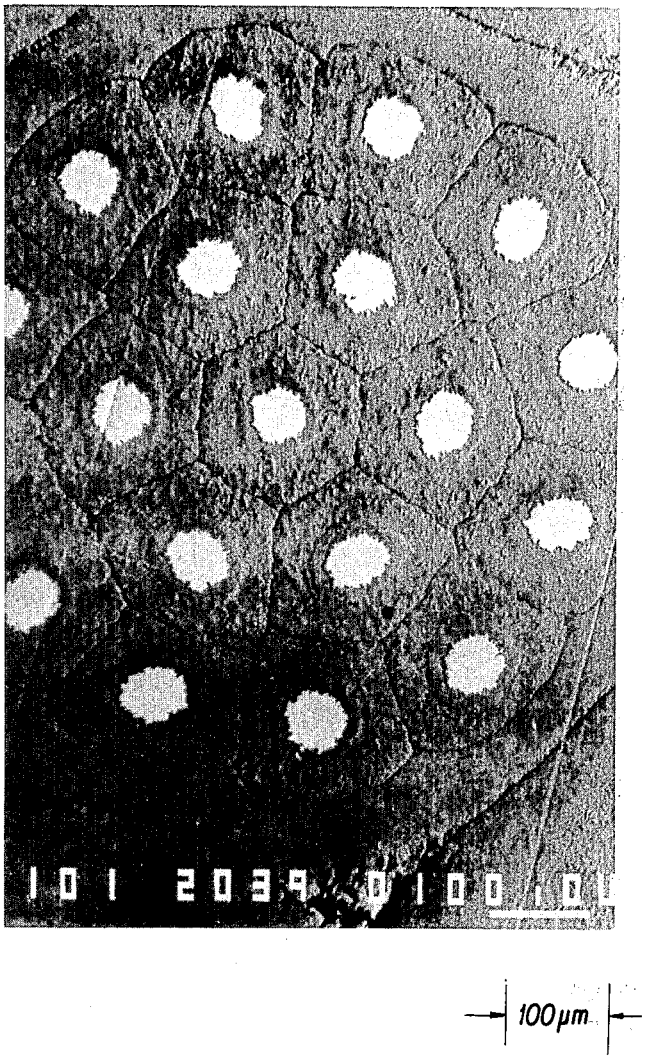
FIGS. 3 and 4 are microscopic photographs of a cross-section of multifiber matrix elements during a stage in fabrication of the electrical brush of the invention.
Figure 4:
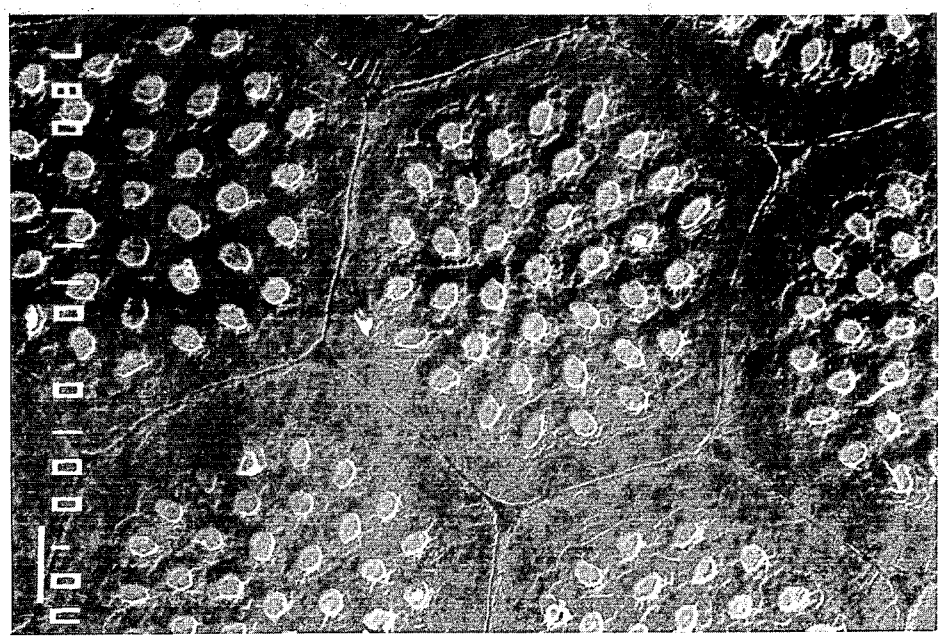

FIGS. 3 and 4 depict examples of the multi-filamentary material stock that results from utilization of the preferred laboratory method, i.e. the second method, of brush stock manufacture of the invention. In FIG. 4, niobium fibers having diameters of approximately 60 μm are shown embedded in a copper matrix. In FIG. 3, gold fibers with a diameter of approximately 38 μm are likewise shown embedded in a copper matrix. FIGS. 3 and 4 clearly show the local fiber spacing uniformity attainable by initial filamentary sheathing according to the preferred method embodiment, with FIG. 3 further illustrating the bundle-to-bundle spacing uniformity realized according to the invention. In the third method, in which thin fiber wires are first coated with matrix material before sets of these are put into a tubing to be further handled as in the first method, the separation of the individual fibers will be similarly assured, even at the upper limit of useful packing densities, i.e. $<25\%$. The resulting local irregularities in fiber spacing are not detrimental to brush performance, nor is the tufting that results from rebundlings in any of the discussed methods.

As noted above, for extremely thin, closely spaced fiber wires, the etching times required in conventional etching, by merely immersing the drawn and shaped end of a multi-filamentary material into the etchant, often are unacceptably long when removal of matrix material from the fibers over depths much larger than several times the mutual spacing of the fibers is desired, whether the etching depth is measured from an end surface or from a surface parallel to the fibers. Etching times can be substantially reduced by applying ultrasound, as noted already. However, according to the invention, yet much more efficient etching of multifilamentary materials, or indeed etching of a wide range of other materials with second phases of different shapes, is made possible by etching in a centrifuge. In this way, i.e. by centrifuging, the driving force for the convection currents in the etchant which otherwise is simply provided by gravity is magnified manifold through the developed centrifugal force whereby hundreds or thousands of "g's" can be readily attained. Thus, according to the invention, the multifilamentary brush stock is immersed into the etchant disposed in a centrifuge, care being taken to immerse it to the desired depth and in predetermined orientation not necessarily yielding the same depth of etching over the entire surface. Typically, the shaped end of the brush stock will be inserted so as to face downward with the centrifuge at rest, i.e. outward when the centrifuge is running when the greatly increased convective forces will force etchant circulation among the fibers, since the solution, when being enriched with the metal ions, typically bocomes heavier. However, should particular etchants be selected in which the enriched etchant is less dense than the original solution, or should accumulation of gas bubbles pose a problem, the shaped end of the brush stock is inverted to point upward when the centrifuge is at rest, i.e., radially inwardly into the etchant when the centrifuge is running. In that case, that part of the brush stock which shall not be etched, which normally is surrounded by air above the etchant surface, is immersed to the desired depth in some protective non-corrosive fluid immisible with the etchant, whose specific gravity is larger than that of the etchant, so that the etchant floats on the protective fluid when the centrifuge is at rest, and is supported by it in the outward direction when the centrifuge is running.

Materials combinations for brushes made of only two materials which have been successfully made and tested include filaments of gold, sterling silver, platinum, palladium and niobium in copper, of gold in sterling silver, of copper in aluminum, and of filaments of niobium in a matrix of bronze including shields of tantalum. Based on the success of the brushes fabricated to date, on the theory developed, and on various known facts of materials behavior, it is anticipated that the noble metals, copper, nickel, tungsten, titanium, iron and/or niobium, as well as alloys thereof, are highly suitable for the fiber filaments; niobium, however, only if protected from oxygen during use, and all base metals typically requiring protective atmospheres and/or noble metal platings or barrier layers to achieve adequate or optimum performance. Virtually any electrically conductive material which is chemically stable and solid up to at least 150° C., and which can be etched, melted or dissolved away from the filaments or barriers can be used for the matrix material. For barriers used in order to facilitate etching of the matrix, the preferred barrier material thickness in the final condition before etching lies in the neighborhood of 1 μm. Barriers may consist of more than one layer, e.g. nickel on gold on nickel over copper fibers in a copper matrix to inhibit diffusion.

An important condition is that barriers used to protect fibers from etching attack be non-porous. It has been observed that even minor porosities permit local attack of the fibers, causing the corresponding local weakening. Such local weakening can lead to the breakage of the fibers during later use. Partial or complete healing of the discussed weakening caused by local etching attack beneath barrier material porosities is expected to be achievable by plating of the exposed fibers with another metal, using methods such as sputtering, subliming, electrophoresis, electroplating, chemical vapor deposition, plasma plating and/or other methods. Such platings will often be applied in any event in order to improve brush characteristics beyond those possessed by the brush with its fibers before plating. Examples include the plating of base metal fibers such as of brass, bronze, steels, niobium, with a noble metal or nickel in order to enhance chemical stability, or base metals fibers such as nickel, stainless steel, tungsten and titanium to lower electrical contact resistance.

In the case of aluminum barriers of about 1 μm thickness for the protection of copper fibers from attack during the etching of a copper matrix, porosity of the barriers led to local weakening and subsequent breakage of a significant fraction of the fibers, estimated in the order of 30%. It is realized that dissolved gases are at least partly responsible for barrier porosity, and these should be removed if possible and/or convenient. It is envisaged that the problem of barrier porosity can be overcome in a perhaps simpler manner by the successive application of two or more slightly porous barrier layers of barrier materials not attacked by the etchant, whose total thickness is less than would be required to construct a single non-porous barrier layer, for the reason that statistically it is very rare that porosities in generally continuous layers will coincide locally in two or more barrier layers.

Examples of etching solutions for several different fiber materials, matrix materials and barrier materials are as follows:

EXAMPLES OF ETCHING SOLUTIONS

| FIBER MATERIAL | MATRIX MATERIAL | OUTER BARRIER MATERIAL | ETCHANT | TEMP. |
|---|---|---|---|---|
| Platinum, Niobium Gold | Copper | None | $HNO_3$ | ambient or higher to speed up |
| Sterling Silver (≳20μm dia.) | Copper | None | Sat. $FeCl_3$ in water | 80° C. |
| Copper | Aluminum | None | 20% NaOH water | 60–80° C. |
| Any fiber not attacked by NaOH in water | (matrix previously removed) (etchant to remove barrier) | Aluminum | dilute NaOH in water | ambient |
| Any suitable fiber | Copper (etchant to remove matrix) | Gold | 50% $HNO_3$ in water | ambient or higher to speed up |

-continued

| EXAMPLES OF ETCHING SOLUTIONS | | | | |
|---|---|---|---|---|
| FIBER MATERIAL | MATRIX MATERIAL | OUTER BARRIER MATERIAL | ETCHANT | TEMP. |
| Any suitable fiber | Silver or sterling silver (etchant to remove matrix) | Gold | 50% $HNO_3$ in water | ambient or higher to speed up |
| Platinum Gold | Silver | None | 50% $HNO_3$ in water | ambient or higher to speed up |
| Any suitable fiber | (matrix previously removed) (etchant to remove barrier) | Laquer* or polymer* | Organic solvent | ambient |

*Useable for etching as well as diffusion barriers in selected cases.

Quite a few metal fiber brushes fabricated using the above-described methods have been tested as described in the above-noted article by Adkins and Kuhlmann-Wilsdorf, "Development of High Performance Metal Fiber Brushes, 11-Testing and Properties," *Electrical Contacts,* Ill. Inst. Techn., Chicago, Illinois 1979, and in subsequent experiments. The tested metal fiber brushes provided such a high number of a-spots and had such good compliance that they could be run at much lower mechanical loads (without lubrication in the cases studied) than the best commercially available monolithic brushes of the same size under otherwise same conditions while exhibiting much lower electrical and mechanical losses, especially at high velocities as seen in FIGS. 5 to 10.

In FIGS. 5-9, to which repeated reference has already been made, are illustrated operating characteristics of several brushes constructed according to the invention (solid lines), including mechanical loss ($L_M$), electrical loss ($L_E$) and total loss ($L_T=L_M+L_E$), as compared with the best total loss, $L_T$performance experienced with the conventional silver-graphite brush (SG-142), at the same operating speed, shown in the dashed lines. The SG-143 brush was chosen for purposes of comparison because it exhibits the best known performance among commercially available brushes.

Figure 5:
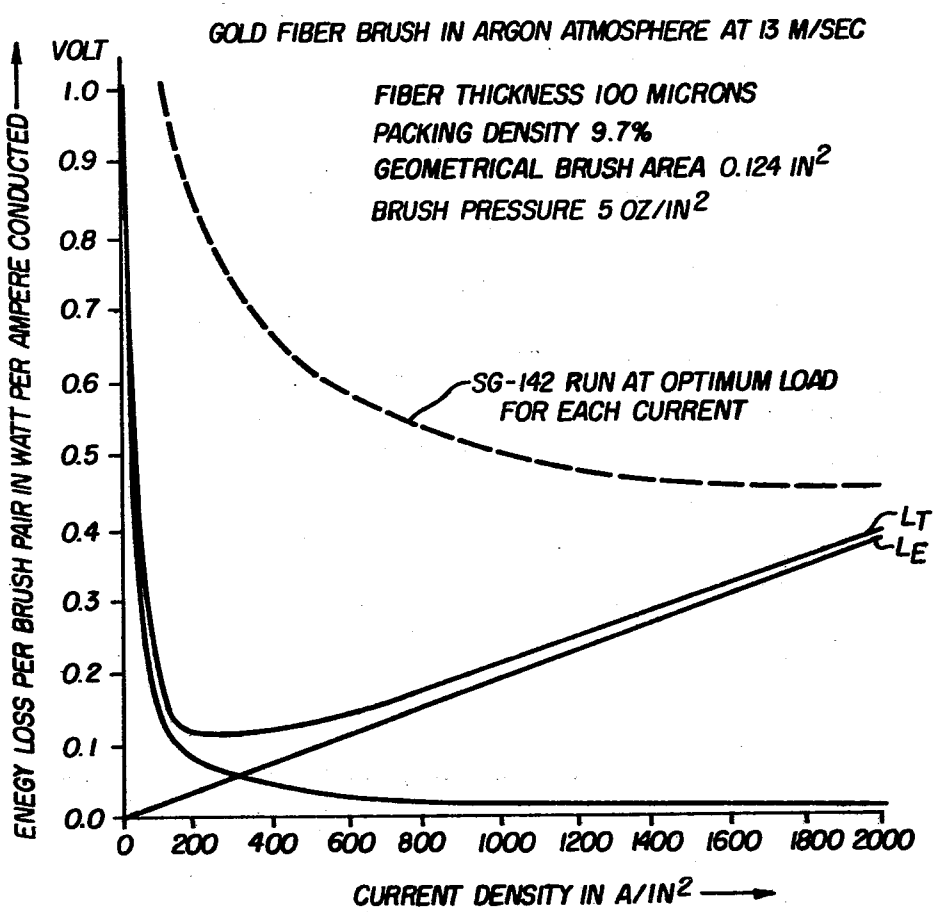
FIGS. 5 to 10 are graphs illustrating selected performance characteristics of the electrical brush of the invention as a function of brush load, material selected, fiber diameter, velocity, current density, and surface treatment of the contacting surface, with some tests (e.g.
Figure 6:
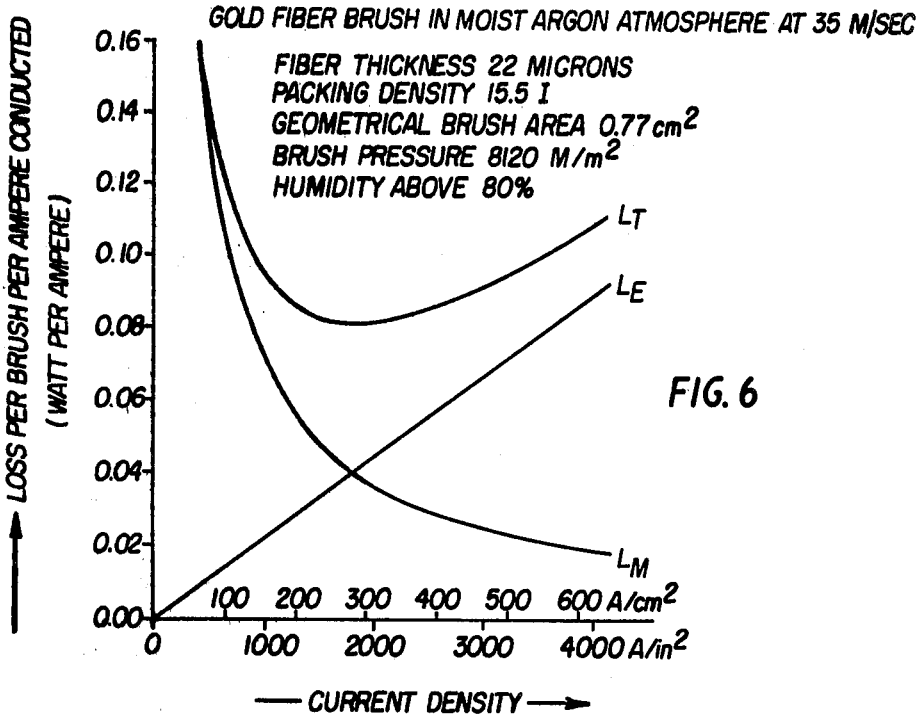
Figure 7:
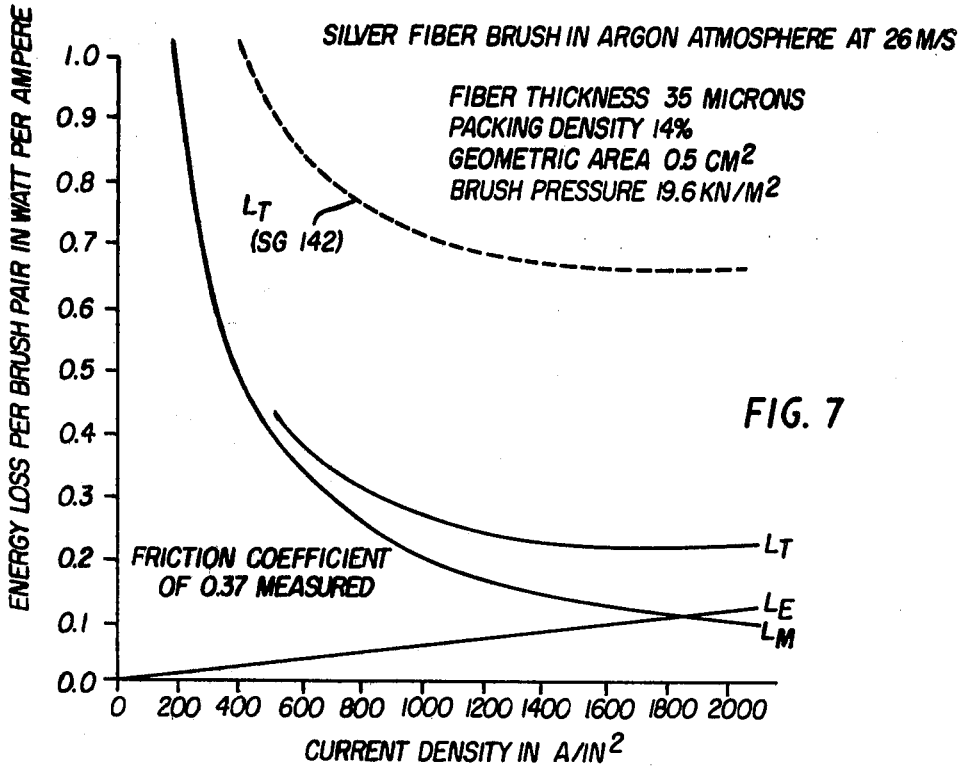

In FIG. 6 are shown performance characteristics for a gold fiber brush tested in a moist Argon atmosphere on a graphitized copper rotor (surface treatment by AMP Corporation, Harrisburg, Pa.) at a speed of 35 m per second. The tested brush has a fiber thickness of 22 μm, a packing density of 15.5%, a geometrical brush area of 0.77 $cm^2$ and was tested at a brush pressure of 8120 $N/M^2$ (i.e. beyond its macroscopic yield point) at a humidity above 80%. This is the best performance so far with a gold fiber brush. In FIG. 5 the performance of another gold fiber brush tested on a polished copper rotor with 100 μm diameter fibers tested at 13 m per second at a light load is compared against the best performance of a conventional silver graphite brush (Stackpole, SG-142). Note that this is a brush near the upper limit of useful fiber sizes and is loaded with much lighter pressure than optimal; and even so its performance is better than that of the monolithic brush. FIGS. 7, 8 and 9 similarly respectively show the performance of silver, copper and platinum brushes, under various conditions, again compared to the monolithic SG-142 brush, whereby it should be noted that the platinum brush was tested in the ordinary laboratory atmosphere.

Figure 10:
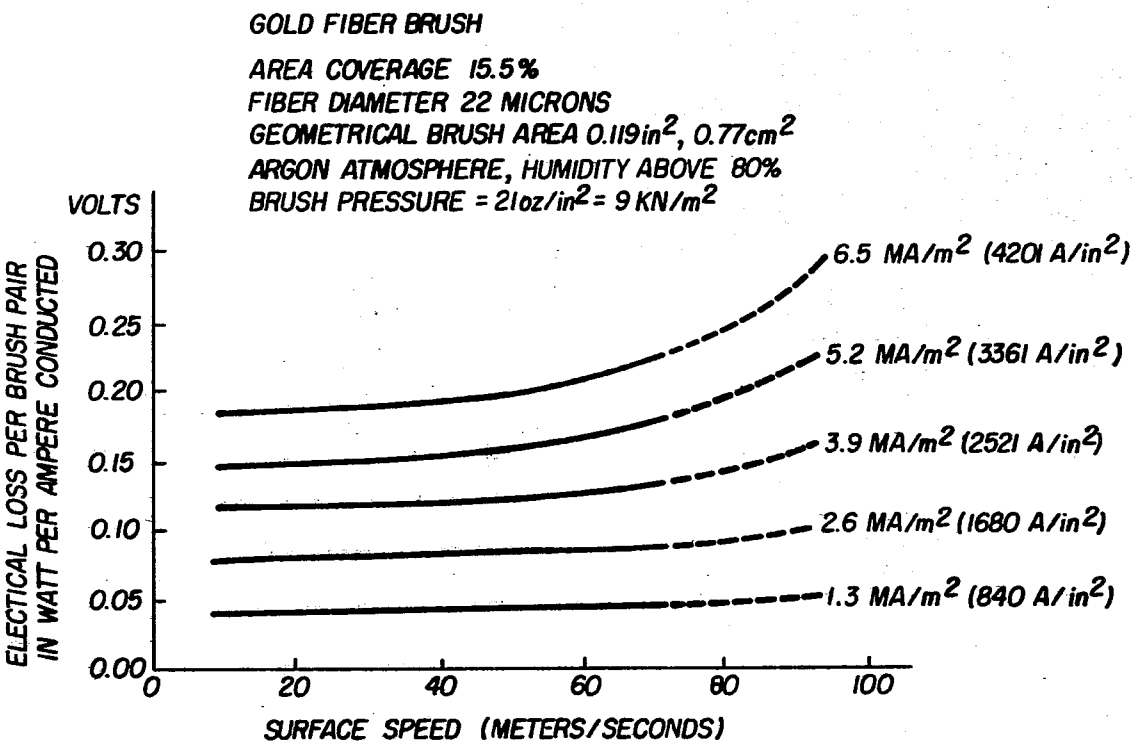

FIG. 10 shows the dependence of the electrical loss of a pair of gold fiber brushes of the same type and under closely the same conditions as in FIG. 6, as a function of surface speed and current density. Comparison with FIG. 5 confirms the great superiority of the fiber brushes according to the invention with the best commercially available monolithic brushes.

With regard to the behavior of silver-graphite brushes, conclusive evidence for the formation and destruction of variable surface films was obtained, which surface films are apparently superimposed on the permanently present very thin surface films to be found on all metals. The nature and thickness of the latter is presumably much the same as for clean copper and silver surfaces since the film resistivity of this component of the surface film is much the same as that given by Holm, *Electric Contacts, Theory and Applications* (4th Ed. N.Y.: Springer Verlag, 1967), for the surface film on the clean materials. The other component, which is prone to build-up and destruction, exhibits a smaller electrical resistance on the cathodic brush than on the anodic brush. It is concluded that this other component is mainly composed of lubricating material or derivatives thereof. This film has a thickness which is increased by moderate heating, and thus initially thickens with rising current and brush velocity. However, at some not well-defined level of applied voltage, the lubricating film is gradually destroyed, in which process mechanical action aids, so that the film disruption occurs at a lower level of heating if the speed is increased. Most markedly, the coefficient of friction is not much different whether the lubrication film is present or not. Correspondingly, it has tentatively been concluded that even in monolithic silver graphite brushes with 75% silver the electrical resistance is increased through lubrication and that the main beneficial effect of the graphite in that case is to improve the mechanical compliance of the brush surface as compared to a monolithic metal brush. Correspondingly, it is held unlikely that lubrication is necessary or desirable for metal fiber brushes.

Under clean conditions and with the use of protective atmospheres the electrical resistance of metal fiber brushes according to the invention shows no difference between anodic and cathodic brushes, but such differences are frequent when oxygen is present. In light of the results pertaining to surface films on silver-graphite brushes, seeing that the multi-fiber brushes according to the invention were run without deliberate lubrication, this shows that common metal surface films can have rectifying properties and/or can be of slightly different nature on the anode and cathode.

Generally, the brush resistance rises with velocity, the more so the thinner the fibers. This is considered to be due to aerodynamic lift. The effect is large at low brush pressures and is strongly reduced if the brush pressure is increased. For the brushes to which FIGS. 6 and 10 pertain, at a brush pressure of 1 lb./in.$^2$ (several thousand N/m$^2$), the brush resistance is almost independent of velocity up to at least 35 m per second and beyond that rises as seen in FIG. 10.

Under clean conditions, brush resistance is ohmic, and it can be independent of current density up to at least 650 A/cm$^2$ (approximately 4,200 A/in$^2$) of geometrical brush area, which was the limit of the available test equipment, as indicated in FIG. 6 and also may be extracted from FIG. 10.

The best results so far obtained during testing of gold fiber brushes according to the invention were with fiber diameters of approximately 20 μm and packing densities between 10% and about 15.5% (FIGS. 6 and 10). When these brushes were run on a carbonized surface provided by AMP Corporation at a brush pressure of 21 oz/in$^2$~9000/m$^2$, the electrical loss at 4200 A/in$^2$=650 A/cm$^2$ lay below 0.1 watt per brush per ampere conducted up to a velocity of about 50 m per second (see FIG. 10). Upper limits of current density as well as velocity in the tests recorded in FIG. 10 were imposed by the testing equipment and do not reflect the limits of brush performance. These data are very superior to any previously known from monolithic brushes.

Theoretical analysis indicates that the number of a-spots per fiber is near unity for the brushes while running, and near three in the stationary case. The decrease of number of a-spots when running as compared to the stationary case is believed to be due to the inability of the fiber tips to reorient fast enough to follow the rapid contour changes of the opposing surface when there is fast relative motion between the brush and its substrate. For the remainder, the results indicate that the brush resistance is essentially controlled by film resistance, and that the contact spots behave elastically, although close to the limit of plasticity. The film resistance on gold under clean conditions inferred from the data in relation to the theory indicates a film resistivity of $5\times10^{-13}\Omega/m^2$. This is close to the smallest value of film resistivity quoted by Holm, supra, for clean gold surfaces.

As shown by Holm, supra, a-spot temperature and voltage drop are correlated in stationary electrical contacts. In the case of relative motion between the two sides of the contact, the temperature at the a-spots is additionally raised due to the input of mechanical energy. In agreement with these facts metal fiber brushes tested so far begin to fail at current densities such that $L_T$, the equivalent voltage drop composed of $L_E$ plus $L_M$, corresponds to the melting temperature, more or less, of the fiber material. Attainable current densities thus rise as brush resistance decreases, but at high brush loads only up to the level at which $L_M$ and $L_E$ have comparable values at peak current density. Other factors being equal, attainable current densities rise with the melting temperature of the fibers.

Since the current path in the metal fiber brushes according to the invention is divided into very many branches, one each of each a-spot, and these act as parallel conductors, the voltage variations due to the establishment or removal of any single a-spot, or changes in the resistance of any single a-spot, affect the overall brush resistance very little. This is quite different in monolithic brushes in which, as mentioned before, there are only one to a few a-spots operating at any moment of time. Correspondingly, the statistical voltage fluctuations across a brush while in operation (known as brush "noise") are much less for metal fiber brushes according to the invention than for monolithic brushes. In a first order approximation, with the number of a-spots of metal fiber brushes about N times larger than of monolithic brushes, with N the number of fibers per brush, one may expect the relative noise in a fiber brush operating under otherwise similar conditions to be smaller by a factor of about $1/\sqrt{N}$ than for a monolithic brush. Measurements bear out the expectation of a greatly reduced brush noise in accordance with the above theoretical consideration, as shown in FIGS. 11*a* and 11*b*. FIGS. 11*a* and 11*b* are a comparison of the cathodic ($V_C$) and anodic ($V_A$) voltage drops and their fluctuations (i.e. the "noise"), each during one-half revolution, for a monolithic silver-graphite brush run under optimal conditions (FIG. 11*a*) and a gold fiber brush according to the invention (FIG. 11*b*) at a current density of 2000 Amp/in$^2$=310 Amp/cm$^2$ and a speed of 1060 ft/sec=35 m/sec. The brush area in both cases is about 0.1 in$^2$, the characteristics of the fiber brush are the same as for FIGS. 6 and 10. Brush noise being of prime consideration in a variety of applications, this low noise level of metal fiber brushes is considered to be of great potential benefit, independent of the other performance characteristics of the brushes.

The dependence of brush resistance on load in the stationary as well as the running case is consistent with theory within the error limits of measurement, and also the relative magnitudes of the brush resistances for brushes of different construction obey theory. Thus, it is considered that the behavior of the metal fiber brushes according to the invention is well understood. The perhaps most remarkable feature of the testing results summarized in the Adkins and Kuhlmann-Wilsdorf article, supra, is that the contribution of electrons tunneling through an annular area about the individual a-spots makes a significant contribution to the conductivity. This is due to the fact that the individual a-spots are very small indeed, and are very small compared to the radius of curvature of the contacting surfaces.

Recapitulating, this invention involves metal fiber brushes of a kind which at the same time have a high number of a-spots and such good compliance that they can be run at much lower loads (without lubrication) than monolithic brushes of the same size while exhibiting lower electrical and mechanical losses, especially at high velocities, and wherein the size of the a-spots can be made so small that tunneling of electrons through the annular gaps (of less than about 10 angstroms width) about the a-spots can add substantially to the current conduction.

Figure 11:
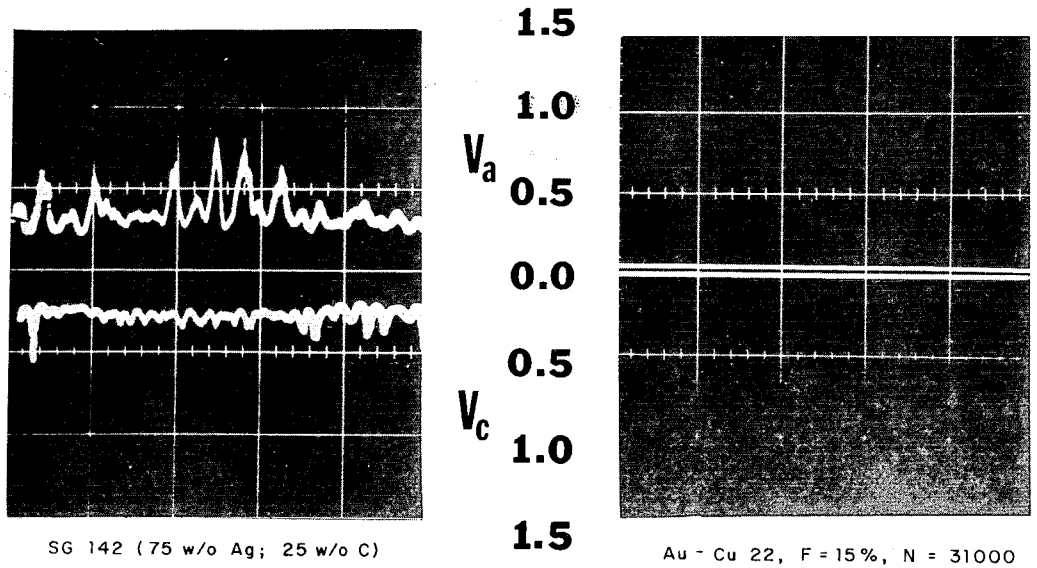
FIGS. 11*a* and 11*b* are photos comparing noise voltage fluctuations, experienced with a monolithic silver-graphite brush and with a gold fiber electrical brush according to the invention, respectively.

When viewed in the broader sense of metal fiber surfaces of thin fairly uniformly distributed fibers (often locally collected in bundles as in ordinary brushes) with a smooth macroscopic surface, comparing monolithic brushes with fiber brushes of the same material, the specific superior properties of such "metal velvets" or fiber surfaces as produced according to the invention, somewhat independent of material within a range of metals (including gold, silver and copper, among others) and in suitable atmospheres (e.g. air and/or argon, carbon dioxide, helium, etc.), are:

(i) Low contact resistance in stationary contacts, much below that of the same combination of mating surfaces when these are monolithic and in the same ambient atmosphere;

(ii) As in (i) above, but for moving contacts, including the possibility to attain very high current densities and speeds, not hitherto attained with similarly low losses by any monolithic brushes (FIG. 10);

(iii) Much lower electrical/radio "noise" than obtainable with monolithic brushes (FIG. 11).

It should also be noted that the forecast cost of the new fiber brushes in industrial production as taken per amphere conducted is expected to be very competitive, less than the energy savings over the expected lifetime of the brushes when used instead of conventional brushes. Therefore net savings are forecast through the replacement of conventional brushes by fiber brushes according to the invention, e.g. in electrical power generation. This cost advantage arises because of the low losses per ampere conducted that can be achieved and the potentially high current densities that can be used. Correspondingly, it is anticipated that the metal fiber material can be applied with great success in switches as well as for brushes in all cases in which it is desired either in obtain low total losses, and/or low electrical or mechanical losses separately, and/or low "noise", and/or high relative contact speeds, and/or high current densities. The specific fiber materials, fiber platings or barriers, thicknesses, packing densities, lengths, and ambient atmospheres will depend on specific circumstances. Specific examples have been investigated to assure that under suitable conditions the above claims pertain to the geometry of the material, i.e. being fibrous and compliant, in principle, as summarized in the above-noted Adkins and Kuhlmann-Wilsdorf article, supra, and subsequent tests as shown in FIGS. 5 to 10.

Obviously, numerous modifications and variations of the present invention are possible in light of the above teachings. For example, conceivably an electrical fiber brush according to the invention may be constructed employing fibers of different materials shaped to predetermined dimensions and/or geometrical arrangements to impart to the electrical brush various properties characteristic of the fibers of the different materials. As another example, metal fiber brushes according to the invention may be constructed to have different fiber diameters and/or packing densities in different parts of the brush surface, e.g. thicker fibers about the circumference to reduce the effects of aerodynamic lift.

Furthermore, whereas during the above-noted centrifical etching it is generally envisioned that the brush stock is immersed in the etchant in a direction more or less perpendicular to the centrifuge rotational axis when running, it is anticipated that for brushes with one or two small dimensions and long intended fiber lengths, it may be desirable to re-orient the brush stock so as to be more nearly parallel to the centrifuge axis when running, to speed up etching of the brush stock. Furthermore, it is envisaged that in industrial brush manufacture, sets of plural similar shaped pieces of brush stock will be etched together by placing them into trays or other devices, permitting the rapid accurate positioning of the shaped brush stock pieces relative to the same planar or cylindrically curved surface, and then positioning that tray or other holding device relative to the etchant surface to insure that all brush stock pieces are dipping into the etchant to the same depth. If etching is done in a centrifuge, the surface of the etchant will be cylindrically curved, otherwise it will be planar. In such a method etching can be done simply by dipping, by applying ultrasound, by moving the tray or holding device relative to the container in which the etchant is contained, by circulating the etchant under the tray or holding device, in the centrifuge, or combinations thereof.

Similarly, it is envisaged that in industrial brush manufacture shaping of the brush stock ends may be done in sets of similar pieces, say using drilling along the center axis when the pieces are disposed on a conical holder; or cutting off with a saw when the pieces are assembled in parallel sets and the intended contacting surface is planar; or cutting with a rotating tool when the pieces are disposed in suitable cylindrical arrangements.

Furthermore, in some manufacturing methods the fibers could be embedded in the matrix in groups of more than one without grossly affecting brush behavior. Also, larger brushes could be assembled from smaller brushes, such assembling being done before or after etching, whereby the fiber directions in the different component brush stock pieces would not necessarily all be parallel. This would be especially useful in order to construct metal fiber brushes according to the invention, such that one brush would cover all or a substantial part of the outer circumference of an axis, rotor or commutator, or of an inside groove or surface of a cylindrical hole of a contact. Further, by suitable nonuniform deformation of the stock during manufacture, the fibers could be made to be flat rather than cylindrical, or to have gradual change in direction remaining parallel to each other on a small scale but changing direction over distances large compared to their diameter or mutual spacing, whichever may be the smaller. It is therefore to be understood that within the scope of the appended claims, the invention may be practiced otherwise than as specifically described herein.

What is claimed as new and desired to be secured by Letters Patent of the United States is:

1. An electrical brush for making an electrical connection to an object having a predetermined shape, comprising:

an electrically conductive matrix material;

plural metal fiber wires embedded in said matrix material and defining a longitudinal axis, said fiber wires having a diameter (d), a length (l) extending from said matrix material, and a packing density (f) defined as the ratio of the total cross-sectional area of the fiber wires relative to the cross-sectional area of the matrix material in a plane cutting the longitudinal axis of said fiber wires, wherein $$1\ \mu m < d < 120\ \mu m \quad \text{(a)}$$

$$(d/l) < 0.05 \quad \text{(b)}$$

$$1\% < f < 25\% \quad \text{(c)}$$

2. An electrical brush according to claim 1, wherein: $3\ \mu m < d < 60\ \mu m$.

3. An electrical brush according to claim 1, wherein: $5\ \mu m < d < 50\ \mu m$.

4. An electrical brush according to claim 1, wherein: $10\ \mu m < d < 40\ \mu m$.

5. An electrical brush according to claim 1, wherein: $12\ \mu m < d < 35\ \mu m$.

6. An electrical brush according to claim 1, wherein: $1\% < f < 20\%$.

7. An electrical brush according to claim 1, wherein: $2.5\% < f < 20\%$.

8. An electrical brush according to claim 1, wherein: $2.5\% < f < 18\%$.

9. An electrical brush according to claim 1, wherein

5% < f < 17%.

10. An electrical brush according to claim 1, wherein:
6 μm < d < 50 μm; and
2.5% < f < 20%.

11. An electrical brush according to claim 1, further comprising:
said fiber wires consisting of a material selected from the group consisting of a noble metal, Cu, Ni, Fe, Nb, W, Ti and high concentration alloys thereof.

12. An electrical brush according to claim 11, further comprising:
said fiber wires consisting of a material selected from the group consisting of a noble metal, Cu, Ni, Fe, Nb, W, Ti and high concentration alloys thereof to which is added a predetermined amount less than 5% by weight of Zr.

13. An electrical brush according to claim 1, further comprising:
said fiber wires consisting of a material selected from the group consisting of Pt, Rh, Au, Ag, Pd, Ni, Cu, Fe and high concentration alloys thereof.

14. An electrical brush according to claim 1, wherein said matrix material comprises a metal having a melting temperature greater than 300° C.

15. An electrical brush according to claim 1, further comprising:
said matrix material selected from the group consisting of Cu, Al, Ag, Fe, Ni and high concentration alloys thereof.

16. An electrical brush according to claim 1, further comprising:
said matrix material consisting of stainless steel, brass or bronze.

17. An electrical brush according to claim 1, further comprising:
said matrix material consisting of Cu, Al or Ag.

18. An electrical brush according to claim 1, further comprising:
said matrix material consisting of Cu.

19. An electrical brush according to claim 1, further comprising:
said fiber wires extending straightly from said matrix material in a generally mutually parallel orientation.

20. An electrical brush according to claim 1, further comprising:
a barrier material of at least one metal layer provided at least on the lateral surface area of that portion of each fiber wire extending from said matrix material.

21. An electrical brush according to claim 1, further comprising:
a barrier material of at least one layer provided at least on the lateral surface area of that portion of each fiber wire embedded in said matrix material.

22. An electrical brush according to claim 1, further comprising:
a multilayer barrier material of which at least one layer is formed on at least part of that portion of each fiber wire extending from said matrix material.

23. An electrical brush according to claim 20, further comprising:
said at least one layer deposited on at least part of said portion of each fiber wire extending from said matrix material.

24. An electrical brush according to claims 20 or 23, wherein said at least one metal barrier layer in use exhibits a lower film resistance against the contact surface of said object than that which base fibers would otherwise exhibit.

25. An electrical brush according to claim 20, further comprising:
said barrier material selected from the group consisting of noble metals, Ni, Cu, Cr, Fe, layered combinations thereof and high concentration alloys thereof.

26. An electrical brush according to claim 20, further comprising:
said barrier material selected from the group consisting of noble metals, Ni, Cu, high concentration alloys thereof, and layered combinations thereof.

27. An electrical brush according to claim 20, further comprising:
said barrier material selected from the group consisting of Pt, Ir Rh, Au, Ag, Pd, Al, Cu, Ni, high concentration alloys thereof and layered combinations thereof.

28. An electrical brush according to claim 10, further comprising:
said fiber wires selected from the group consisting of Pt, Rh, Au, Ag, Pd, Ni, Cu, Fe, Ti, W, and high concentration alloys thereof; and
said matrix material selected from the group consisting of Cu, Al, Ag, Fe, and high concentration alloys thereof.

29. An electrical brush according to claims 20, 21, 22, 23 or 25, wherein:
6 μm < d < 50 μm; and
2.5% < f < 20%.

30. An electrical brush according to claim 29, further comprising:
said fiber wires selected from the group consisting of Pt, Rh, Au, Ag, Pd, Ni, Cu, Fe, Ti, W and high concentration alloys thereof; and
said matrix material selected from the group consisting of Cu, Al, Ag, Fe, and high concentration alloys thereof.

31. An electrical brush according to claim 1, further comprising:
said fiber wires made of rhodium; and
said matrix material made of silver or high concentration silver alloy.

32. An electrical brush according to claim 1, further comprising:
said fiber wires having ends which are compositely shaped to a predetermined shape in correspondence to the predetermined shape and a predetermined relative positioning of said object.

33. An electrical brush according to claim 1, further comprising:
said fiber wires consisting of a material selected from the group consisting of a nobel metal, Cu, Ni, Fe, Nb, W, Ti, and high concentration alloys thereof to which is added a predetermined amount less than 5% by weight of Ir, Rh or Zr.

* * * * *